US006145961A

United States Patent [19]

Otsuki

[11] Patent Number: 6,145,961

[45] Date of Patent: Nov. 14, 2000

[54] INK-JET PRINTING APPARATUS AND INK RESERVOIR UNIT ATTACHED THERETO

[75] Inventor: Koichi Otsuki, Nagano-ken, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/145,613

[22] Filed: Sep. 2, 1998

[30] Foreign Application Priority Data

Sep. 4, 1997 [JP] Japan ..... 9-257661
Oct. 17, 1997 [JP] Japan ..... 9-303573

[51] Int. Cl.[7] ..... B41J 2/21

[52] U.S. Cl. ..... 347/43; 347/100

[58] Field of Search ..... 347/43, 15, 100, 347/86

[56] References Cited

U.S. PATENT DOCUMENTS 5,742,306 4/1998 Gompertz et al. ..... 347/43
5,825,377 10/1998 Gotoh et al. ..... 347/15

FOREIGN PATENT DOCUMENTS 0 388 978 9/1990 European Pat. Off. .
0 532 302 3/1993 European Pat. Off. .
0 610 096 8/1994 European Pat. Off. .
6-226998 8/1994 Japan .
7-125262 5/1995 Japan .
7-132619 5/1995 Japan .

*Primary Examiner*—Thinh Nguyen
*Attorney, Agent, or Firm*—Oblon, Spivak, McClelland, Maier & Neustadt, P.C.

[57] ABSTRACT

An ink-jet head assembly includes a plurality of ink-jet heads that are fixed mutually. A first ink-jet head has a plurality of deep cyan nozzles and a plurality of deep magenta nozzles, whereas a second ink-jet head has a plurality of light cyan nozzles and a plurality of light magenta nozzles. The plurality of nozzles of the respective inks are positioned in such a manner that the plurality of nozzles of an identical color and an identical density are arrayed substantially along a sub-scanning direction and that neither the nozzles of different colors nor the nozzles of different densities are located on an identical straight line extending in the sub-scanning direction. The respective one nozzles of deep cyan ink, deep magenta ink, light cyan ink, and light magenta ink are positioned to be aligned in a straight line extending in a main scanning direction. Even when the number of nozzles is increased, this arrangement effectively prevents deterioration of the picture quality due to misalignment of dot formation positions in the main scanning direction and facilitates manufacture of the ink-jet heads.

7 Claims, 16 Drawing Sheets

INK-JET PRINTING APPARATUS AND INK RESERVOIR UNIT ATTACHED THERETO

BACKGROUND OF THE INVENTION

1. Field of the Invention

The present invention relates to an ink-jet printing apparatus that jets at least two different types of inks having different densities with respect to a plurality of ink colors, as well as to an ink reservoir unit attached to such an ink-jet printing apparatus.

2. Description of the Related Art

Color printers with a print head that jets inks of plural different colors have been widely used as the output apparatus of the computer that prints the image processed by the computer in a multi-color, multi-tone form. FIG. 21 illustrates an ink-jet head 100 included in such a printing apparatus. The ink-jet head 100 includes a black ink nozzle array $K_D$ for jetting black ink, a deep cyan ink nozzle array $C_D$ for jetting deep cyan ink, a light cyan ink nozzle array $C_L$ for jetting light cyan ink, a deep magenta ink nozzle array $M_D$ for jetting deep magenta ink, a light magenta ink nozzle array $M_L$ for jetting light magenta ink, and a yellow ink nozzle array $Y_D$ for jetting yellow ink. The number of nozzles included in each nozzle array is, for example, 32.

The first capital alphabet included in the symbol showing each nozzle array represents the ink color. The subscript 'D' denotes the ink of a comparatively high density, and the subscript 'L' denotes the ink of a comparatively low density. The subscript 'D' in the yellow ink nozzle array $Y_D$ implies that gray color is made by mixing substantially equal amounts of the yellow ink jetted from this nozzle array, the deep cyan ink, and the deep magenta ink. The subscript 'D' in the black ink nozzle array $K_D$ implies that the black ink jetted from this nozzle array is not gray but black having the density of 100%.

A plurality of nozzles included in each nozzle array are aligned in a sub-scanning direction SS. The six nozzle arrays are arranged in such a manner that six nozzles for jetting six different inks are aligned in one straight line extending in a main scanning direction MS. The alignment of the six nozzles for jetting six different inks in the main scanning direction MS prevents deterioration of the picture quality due to misalignment of the dots of different colors in the sub-scanning direction.

Color printing requires a significantly longer time period than black and white printing. It is thus highly demanded to increase the number of nozzles for each ink, in order to improve the speed of color printing.

In the conventional arrangement, the nozzles for all the inks are formed in one ink-jet head 100. The arrangement of the ink-jet head in which an extremely large number of nozzles are formed, however, lowers the manufacturing yield. The desired printing apparatus has an ink-jet head that effectively prevents deterioration of the picture quality due to misalignment of dot formation positions in the main scanning direction even in the case of an increased number of nozzles formed in the ink-jet head and that is readily manufactured.

It is here assumed that natural images, such as photographs of landscape and portrait, are printed by a printing apparatus that uses inks of comparatively high densities and inks of comparatively low densities for specific colors (cyan and magenta in the example of FIG. 21). In this case, the positional accuracy of the impact area (that is, the accuracy of the position where ink jetted from the ink-jet head impacts on a printing medium) especially with respect to the inks of comparatively low densities significantly affects the picture quality of a printed image. The low positional accuracy of the impact area with respect to the inks of comparatively low densities undesirably causes banding and harshness in low-density areas, which are often included in the natural images, and thereby deteriorates the picture quality. The arrangement of the ink-jet head in which an extremely large number of nozzles are formed with the high positional accuracy of the impact area of the inks jetted therefrom further lowers the manufacturing yield.

SUMMARY OF THE INVENTION

The object of the present invention is thus to provide a printing apparatus with an ink-jet head that effectively prevents deterioration of the picture quality due to misalignment of dot formation positions in a main scanning direction even in the case of an increased number of nozzles formed in the ink-jet head, that is readily manufactured, and that effectively prevents deterioration of the picture quality due to the lowered positional accuracy of the impact area.

At least part of the above and the other related objects is realized by a first ink-jet printing apparatus that that jets at least two types of inks having different densities with respect to at least cyan and magenta. The first ink-jet printing apparatus has an ink-jet head assembly, which includes a plurality of ink-jet heads that are fixed mutually. The plurality of ink-jet heads include: a first ink-jet head having a plurality of deep cyan nozzles for jetting deep cyan ink having a comparatively high density and a plurality of deep magenta nozzles for jetting deep magenta ink having a comparatively high density; and a second ink-jet head having a plurality of light cyan nozzles for jetting light cyan ink having a comparatively low density and a plurality of light magenta nozzles for jetting light magenta ink having a comparatively low density. The plurality of nozzles of the respective inks are positioned in such a manner that the plurality of nozzles for an identical ink are arrayed substantially along a sub-scanning direction of the ink-jet printing apparatus and that the nozzles for different color inks are not located on an identical straight line extending in the sub-scanning direction and that the nozzles for different density inks are not located on an identical straight line extending in the sub-scanning direction. The nozzles of the deep cyan ink, the deep magenta ink, the light cyan ink, and the light magenta ink are positioned on a plurality of straight lines which respectively extend in a main scanning direction of the ink-jet printing apparatus and which are arranged at a fixed pitch in the sub-scanning direction.

The ink-jet head assembly includes a plurality of ink-jet heads, so that the number of nozzles included in each ink-jet head is decreased. Even when the total number of nozzles is increased, this arrangement enables each ink-jet head to be manufactured readily. The positional accuracy of the nozzles included in each ink-jet head is equivalent to that in the conventional structure. The positional accuracy of the dots of the deep magenta and the deep cyan and the positional accuracy of the dots of the light magenta and the light cyan are thus equivalent to those in the conventional structure. This arrangement effectively prevents excessive misalignment of the dot formation positions in the main scanning direction with respect to at least the dots of the equivalent densities. Compared with the structure that uses a single ink-jet head, this structure reduces deterioration of the picture quality due to the misalignment of dots.

The present invention is also directed to a second ink-jet printing apparatus that jets at least two types of inks having different densities with respect to at least cyan and magenta. The second ink-jet printing apparatus has an ink-jet head assembly, which includes a plurality of ink-jet heads that are fixed mutually. The plurality of ink-jet heads include: a first ink-jet head having a plurality of deep cyan nozzles for jetting deep cyan ink having a comparatively high density and a plurality of deep magenta nozzles for jetting deep magenta ink having a comparatively high density; and a second ink-jet head having a plurality of light cyan nozzles for jetting light cyan ink having a comparatively low density and a plurality of light magenta nozzles for jetting light magenta ink having a comparatively low density. The nozzles included in the second ink-jet head has a higher positional accuracy of an impact area of the ink on a printing medium than that of the nozzles included in the first ink-jet head.

The second ink-jet head, which jets the light cyan ink and the light magenta ink of the comparatively low densities, has the nozzles of the higher positional accuracy of the impact area of the ink than the first ink-jet head. This arrangement reduces banding and harshness in a printed natural image and thereby prevents deterioration of the picture quality.

The present invention is further directed to a third ink-jet printing apparatus that jets at least two types of inks having different densities with respect to at least one specific color. The third ink-jet printing apparatus has an ink-jet head assembly, which includes a plurality of ink-jet heads that are fixed mutually. The plurality of ink-jet heads include: a first ink-jet head having a plurality of deep ink nozzles for jetting deep ink having a comparatively high density of the specific color; and a second ink-jet head having a plurality of light ink nozzles for jetting light ink having a comparatively low density of the specific color. The nozzles included in the second ink-jet head has a higher positional accuracy of an impact area of the ink on a printing medium than that of the nozzles included in the first ink-jet head.

In the third ink-jet printing apparatus, the ink-jet head assembly includes the first ink-jet head that jets the ink having a comparatively high density of the specific color and the second ink-jet head that jets the ink having a comparative low density of the specific color. The second ink-jet head has the nozzles of the higher positional accuracy of the impact area of the ink than the first ink-jet head. This arrangement reduces banding and harshness in a printed natural image and thereby prevents deterioration of the picture quality.

The present invention is also directed to a fourth ink-jet printing apparatus that jets at least two types of inks having different densities with respect to at least cyan and magenta. The fourth ink-jet printing apparatus has an ink-jet head assembly, which includes a plurality of ink-jet heads that are fixed mutually. The plurality of ink-jet heads include: a first ink-jet head having a plurality of deep cyan nozzles for jetting deep cyan ink having a comparatively high density, a plurality of deep magenta nozzles for jetting deep magenta ink having a comparatively high density, and a plurality of black nozzles for jetting black ink; and a second ink-jet head having a plurality of light cyan nozzles for jetting light cyan ink having a comparatively low density, a plurality of light magenta nozzles for jetting light magenta ink having a comparatively low density, and a plurality of yellow nozzles for jetting yellow ink. The plurality of nozzles of the respective inks are positioned in such a manner that the plurality of nozzles for an identical ink are arrayed substantially along a sub-scanning direction of the ink-jet printing apparatus and that the nozzles for different color inks are not located on an identical straight line extending in the sub-scanning direction and that the nozzles for different density inks are not located on an identical straight line extending in the sub-scanning direction.

The structure ascertains the high positional accuracy of the dots having comparatively high densities as well as the high positional accuracy of the dots having comparatively low densities. This arrangement accordingly prevents deterioration of the picture quality in a comparatively high-density image area formed by the dots of comparatively high densities and in a comparatively low-density image area formed by the dots of comparatively low densities.

The present invention is further directed to a fifth ink-jet printing apparatus that jets at least two types of inks having different densities with respect to at least cyan and magenta. The fifth ink-jet printing apparatus has an ink-jet head assembly, which includes a plurality of ink-jet heads that are fixed mutually. The plurality of ink-jet heads include: a first ink-jet head having a plurality of deep cyan nozzles for jetting deep cyan ink having a comparatively high density and a plurality of deep magenta nozzles for jetting deep magenta ink having a comparatively high density; and a second ink-jet head having a plurality of light cyan nozzles for jetting light cyan ink having a comparatively low density and a plurality of light magenta nozzles for jetting light magenta ink having a comparatively low density. The fifth ink-jet printing apparatus further has an ink reservoir unit that is divided into at least two reservoir sections, which include: a first reservoir section having at least a deep cyan vessel for storing the deep cyan ink and a light cyan vessel for storing the light cyan ink, the deep cyan vessel and the light cyan vessel being connected with each other; and a second reservoir section having at least a deep magenta vessel for storing the deep magenta ink and a light magenta vessel for storing the light magenta ink, the deep magenta vessel and the light magenta vessel being connected with each other.

In some occasions, the arrangement of the ink reservoir unit effectively saves waste of inks in replacement of the reservoir sections.

The present invention is further directed to a sixth ink-jet printing apparatus that jets at least three types of inks having different densities with respect to at least one specific color. The sixth ink-jet printing apparatus has an ink-jet head assembly, which includes a plurality of ink-jet heads that are fixed mutually. A plurality of first light ink nozzles for jetting first light ink, which has a lowest density among the at least three types of inks having different densities with respect to the specific color, and a plurality of second light ink nozzles for jetting second light ink, which has a second lowest density, are included in an identical ink-jet head.

The structure ascertains the high positional accuracy of the dots having the lowest density and the dots having the second lowest density. This arrangement accordingly prevents deterioration of the picture quality in a low-density image area formed by the dots of lower densities.

The present invention is further directed to a seventh ink-jet printing apparatus that jets at least two types of inks having different densities with respect to at least cyan and magenta. The seventh ink-jet printing apparatus has an ink-jet head with an actuator for jetting ink. At least an array of light cyan nozzles for jetting light cyan ink having a comparatively low density and an array of light magenta nozzles for jetting light magenta ink having a comparatively low density are constructed by an identical actuator.

This arrangement assures substantially identical positional accuracy of the impact areas of the light cyan ink and the light magenta ink, thereby improving the quality of natural images reproduced by dots of these light cyan ink and light magenta ink. Especially in the case of printing natural images by dual-way printing, the positions of impact areas of the light cyan ink and the light magenta ink are not deviated from each other in the main scanning direction. This effectively prevents harshness of the resulting printed image and deterioration of the picture quality.

The present invention is also directed to a first ink reservoir unit attached to an ink-jet printing apparatus that jets at least two types of inks having different densities with respect to at least cyan and magenta. The first ink reservoir unit is divided into at least four reservoir sections, which include: a first reservoir section having at least a deep cyan vessel for storing deep cyan ink and a deep magenta vessel for storing deep magenta ink, the deep cyan vessel and the deep magenta vessel being connected with each other; a second reservoir section having at least a light cyan vessel for storing light cyan ink and a light magenta vessel for storing light magenta ink, the light cyan vessel and the light magenta vessel being connected with each other; a third reservoir section having a black vessel for storing black ink; and a fourth reservoir section having a yellow vessel for storing yellow ink.

In some occasions, the arrangement of the first ink reservoir unit effectively saves waste of inks in replacement of the reservoir sections.

The present invention is further directed to a second ink reservoir unit attached to an ink-jet printing apparatus that jets at least two types of inks having different densities with respect to at least cyan and magenta. The ink-jet printing apparatus has an ink-jet head assembly, which includes a plurality of ink-jet heads that are fixed mutually, the plurality of ink-jet heads including: a first ink-jet head having a plurality of deep cyan nozzles for jetting deep cyan ink having a comparatively high density and a plurality of deep magenta nozzles for jetting deep magenta ink having a comparatively high density; and a second ink-jet head having a plurality of light cyan nozzles for jetting light cyan ink having a comparatively low density and a plurality of light magenta nozzles for jetting light magenta ink having a comparatively low density. The second ink reservoir unit is divided into at least two reservoir sections, which include: a first reservoir section having at least a deep cyan vessel for storing the deep cyan ink and a light cyan vessel for storing the light cyan ink, the deep cyan vessel and the light cyan vessel being connected with each other; and a second reservoir section having at least a deep magenta vessel for storing the deep magenta ink and a light magenta vessel for storing the light magenta ink, the deep magenta vessel and the light magenta vessel being connected with each other.

The arrangement that vessels of deep ink and light ink of an identical color are included in an identical reservoir section enables the user to purchase a desired reservoir section without any confusion.

The present invention is further directed to a third ink reservoir unit attached to an ink-jet printing apparatus that jets at least three types of inks having different densities with respect to at least one specific color. The ink-jet printing apparatus has an ink-jet head assembly, which includes a plurality of ink-jet heads that are fixed mutually, wherein a plurality of first light ink nozzles for jetting first light ink, which has a lowest density among the at least three types of inks having different densities with respect to the specific color, and a plurality of second light ink nozzles for jetting second light ink, which has a second lowest density, are included in an identical ink-jet head. The third ink reservoir unit includes one reservoir section that has at least three vessels for storing the at least three types of inks having different densities with respect to the specific color, the at least three vessels being connected to one another.

The arrangement that vessels of inks of an identical color but different densities are included in an identical reservoir section enables the user to purchase a desired reservoir section without any confusion.

These and other objects, features, aspects, and advantages of the present invention will become more apparent from the following detailed description of the preferred embodiments with the accompanying drawings.

DESCRIPTION OF THE PREFERRED EMBODIMENTS

Figure 1:
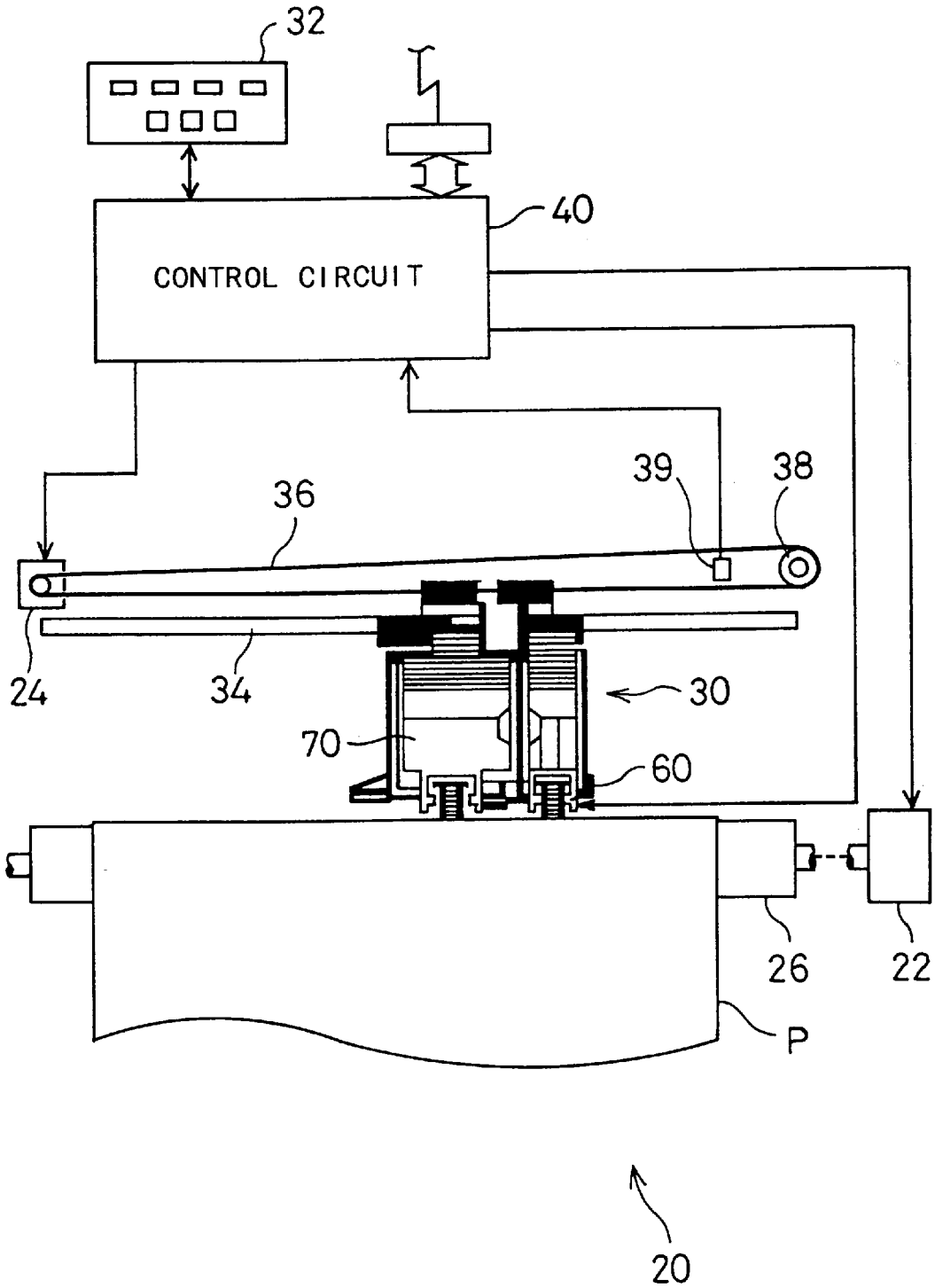
FIG. 1 schematically illustrates the structure of a printer 20 embodying the present invention.

Some modes of carrying out the present invention are described below as preferred embodiments. FIG. 1 schematically illustrates the structure of a printer 20 embodying the present invention. The printer 20 has a mechanism for feeding a sheet of paper P by means of a sheet feed motor 22, a mechanism for reciprocating a carriage 30 along the axis of a platen 26 by means of a carriage motor 24, a mechanism for driving a print head assembly 60 mounted on the carriage 30 to control jet of ink and formation of dots, and a control circuit 40 for transmitting and receiving signals to and from the sheet feed motor 22, the carriage motor 24, the print head assembly 60, and a control panel 32. The print head assembly 60 corresponds to the ink-jet head assembly of the present invention.

The mechanism for feeding the sheet of paper P has a gear train (not shown) that transmits rotations of the sheet feed motor 22 to the platen 26 as well as a sheet feed roller (not shown). The mechanism for reciprocating the carriage 30 includes a sliding shaft 34 arranged in parallel with the axis of the platen 26 for slidably supporting the carriage 30, a pulley 38, an endless drive belt 36 spanned between the carriage motor 24 and the pulley 38, and a position sensor 39 that detects the position of the origin of the carriage 30.

Figure 2:
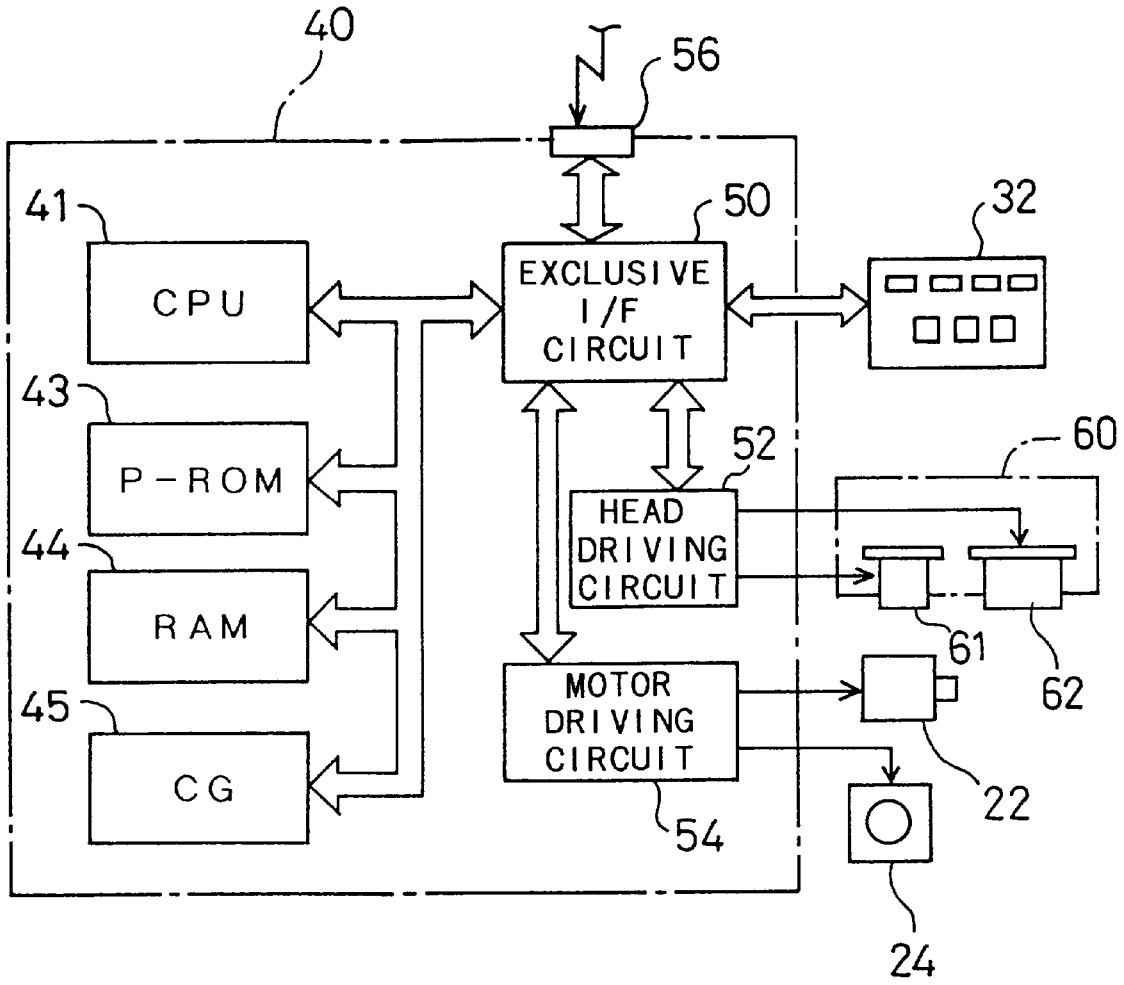
FIG. 2 is a block diagram illustrating the structure of a control circuit 40 included in the printer 20.

FIG. 2 is a block diagram illustrating the structure of the control circuit 40 included in the printer 20. The control circuit 40 is constructed as a logic and arithmetic circuit including a known CPU 41, a P-ROM 43 in which programs are stored, a RAM 44, and a character generator (CG) 45 in which dot matrices of characters are stored. The control circuit 40 further includes an exclusive I/F circuit 50 functioning as an exclusive interface with outer motors and other related elements, a head driving circuit 52 that is connected to the exclusive I/F circuit 50 to drive the print head assembly 60, and a motor driving circuit 54 that is also connected to the exclusive I/F circuit 50 to drive the sheet feed motor 22 and the carriage motor 24. The exclusive I/F circuit 50 includes a parallel interface circuit that is connected to a computer via a connector 56 and receives printing signals output from the computer. The print head assembly 60 includes two print heads 61 and 62, whose structure will be described later.

Figure 3:
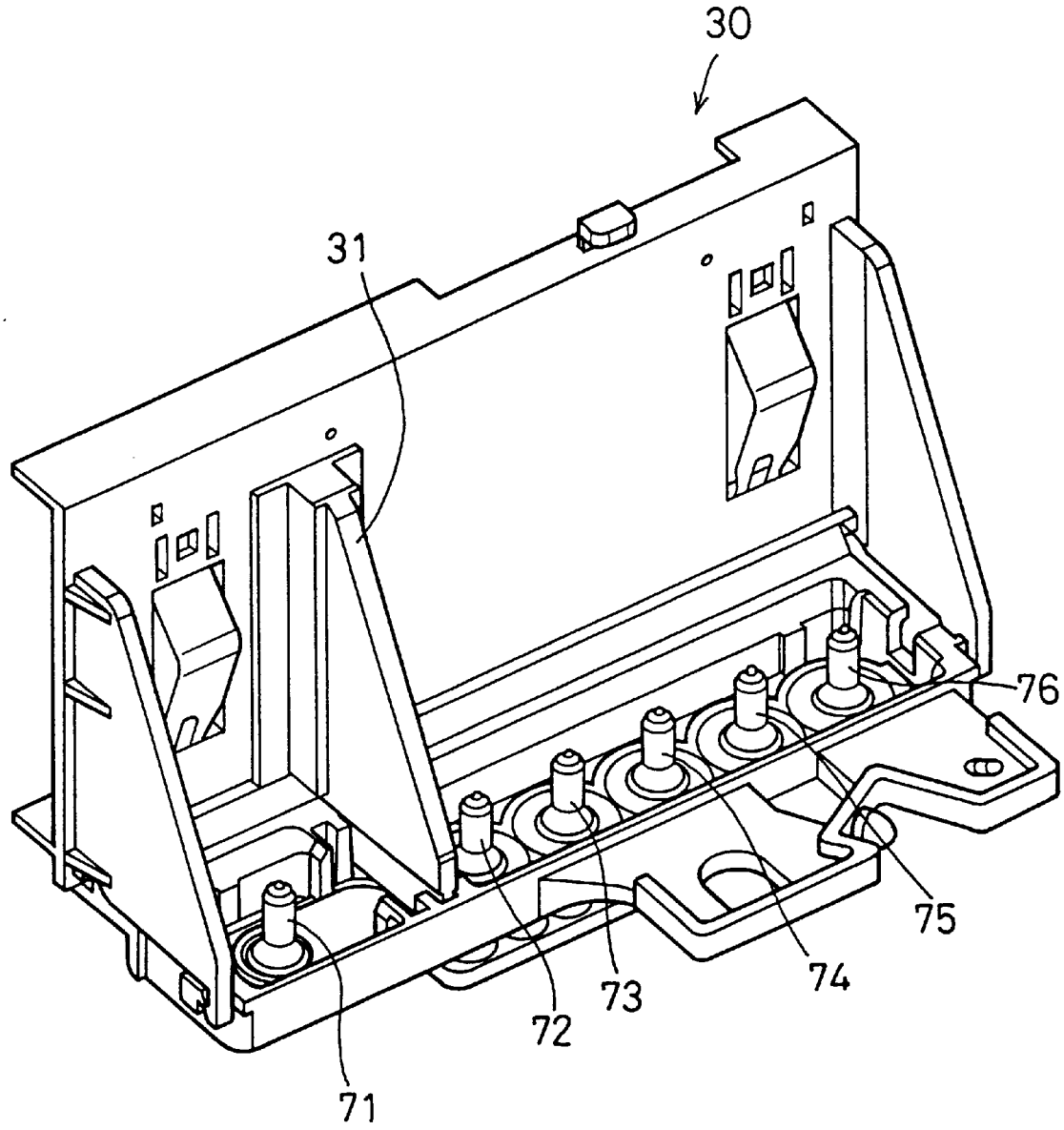
FIG. 3 is a perspective view illustrating the structure of a carriage 30.

The following describes a concrete structure of the carriage 30 and the principle of jetting ink from the print head assembly 60 mounted on the carriage 30. As shown in FIG. 3, the carriage 30 has a substantially L-shaped structure to receive both a black ink cartridge and a color ink cartridge (not shown) mounted thereon, and includes a partition wall 31 that separates the cartridges from each other. Ink supply conduits 71 through 76 are extended upright from the bottom of the carriage 30, in order to feed supplies of ink from ink tanks to the print head assembly 60. When the black ink cartridge and the color ink cartridge are attached downward to the carriage 30, the ink supply conduits 71 through 76 are inserted into connection apertures (not shown) formed in the respective cartridges.

Figure 4A:
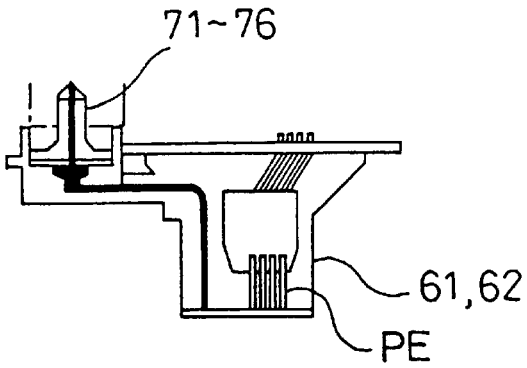
FIGS. 4A and 4B show an ink jetting mechanism in each print head.
Figure 4B:
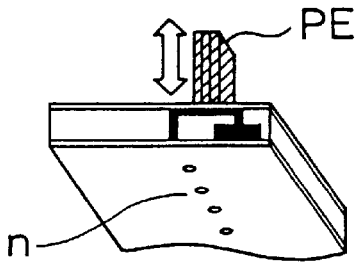

The following briefly describes the mechanism of jetting ink. When the ink cartridges are attached to the carriage 30, supplies of inks in the ink cartridges are sucked out by capillarity via the ink supply conduits 71 through 76 and are led to the two print head 61 and 62 of the print head assembly 60 arranged in the lower portion of the carriage 30 as shown in FIG. 4A. A plurality of nozzles n for each color are arrayed on the respective print heads 61 and 62 as shown in FIG. 4B.

Figure 5A:
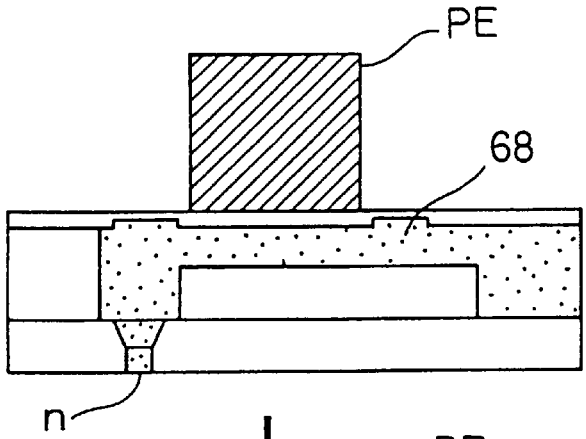
FIGS. 5A and 5B show the state in which an ink particle IP is jetted by extension of a piezoelectric element PE.
Figure 5B:
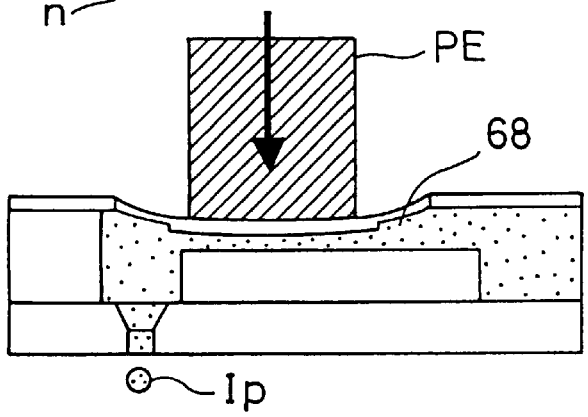

A piezoelectric element PE is arranged for each nozzle n in the respective print heads 61 and 62. As is known, the piezoelectric element PE has a crystal structure that is subjected to a mechanical stress due to application of a voltage and thereby carries out extremely high-speed conversion of electrical energy to mechanical energy. FIGS. 5A and 5B illustrate a configuration of the piezoelectric element PE and the nozzle n. The piezoelectric element PE is disposed at a position that comes into contact with an ink conduit 68 for leading ink to the nozzle n. In this embodiment, application of a voltage between electrodes on either ends of the piezoelectric element PE for a predetermined time period causes the piezoelectric element PE to extend abruptly and deform one side wall of the ink conduit 68 as shown in FIG. 5B. The volume of the ink conduit 68 is reduced with an extension of the piezoelectric element PE, and a certain amount of ink corresponding to the reduced volume is sprayed as an ink particle Ip from the end of the nozzle n at a high speed. The ink particles Ip impact on and soak into the sheet of paper P set on the platen 26, so as to carry out printing.

In the printer 20 of the embodiment having the hardware structure discussed above, while the sheet feed motor 22 rotates the platen 26 and the other related rollers to feed the sheet of paper P, the carriage motor 24 drives and reciprocates the carriage 30, simultaneously with actuation of the piezoelectric elements PE on the two print heads 61 and 62 of the print head assembly 60. The printer 22 accordingly sprays the respective color inks to create dots and thereby forms a multi-color image on the sheet of paper P.

Figure 6:
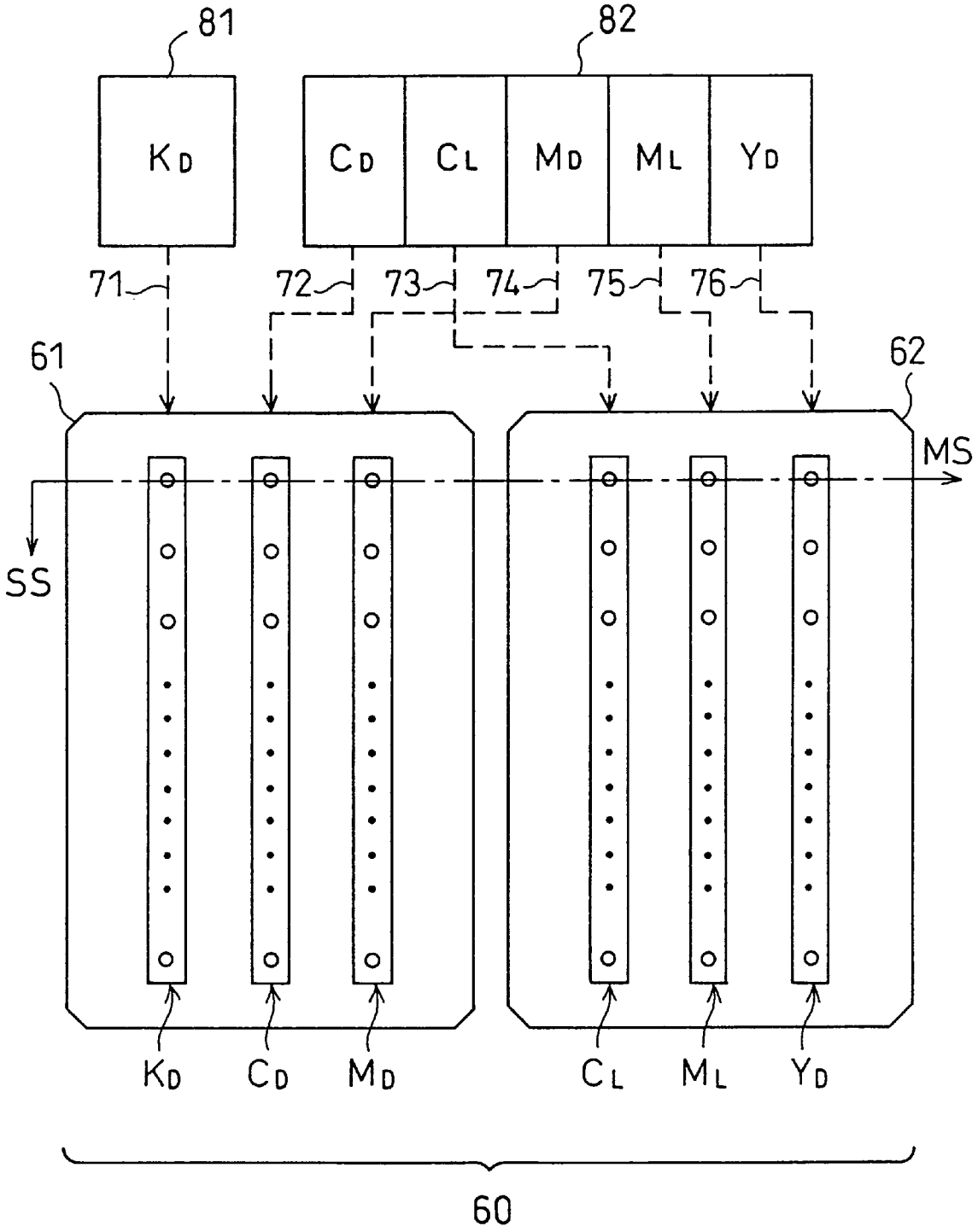
FIG. 6 illustrates the structure of a print head assembly and one possible structure of ink cartridges in a first embodiment according to the present invention.

FIG. 6 illustrates the structure of the print head assembly 60 in a first embodiment according to the present invention. The print head assembly 60 is divided into the two print heads 61 and 62. The two print heads 61 and 62 are fixed to each other by means of a fixing element, such as a screw, and are thereby integrated as one print head assembly 60.

A nozzle array of black ink $K_D$, a nozzle array of deep cyan ink $C_D$, and a nozzle array of deep magenta ink $M_D$ are formed in the first print head 61, whereas a nozzle array of light cyan ink $C_L$, a nozzle array of light magenta ink $M_L$, and a nozzle array of yellow ink $Y_D$ are formed in the second print head 62. The number of nozzles included in each nozzle array with respect to each color is, for example, 64. This is double the number of nozzles (32) typically included in the conventional print head.

The plurality of nozzles for each ink are aligned in a sub-scanning direction SS. The arrangement of the nozzle arrays prevents the nozzles of different colors or the nozzles of different densities from being located on an identical straight line extending in the sub-scanning direction SS. The six nozzle arrays are arranged in such a manner that six nozzles for jetting six different types of inks are aligned in a main scanning direction MS. This arrangement effectively prevents deterioration of the picture quality due to misalignment of the dots formed by different colors in the sub-scanning direction.

One possible structure of ink cartridges 81 and 82 for feeding supplies of inks to the respective nozzle arrays is also illustrated in the upper portion of FIG. 6. The first ink cartridge 81 includes one vessel for storing black ink $K_D$. The second ink cartridge 82 includes five vessels for storing five different color inks other than the black ink (that is, deep cyan ink $C_D$, light cyan ink $C_L$, deep magenta ink $M_D$, light magenta ink $M_L$, and yellow ink $Y_D$). In the specification hereof, each ink and each array of ink nozzles are expressed by the same symbol for convenience of explanation.

In the drawing of FIG. 6, the broken lines extending from the respective vessels of the two ink cartridges 81 and 82 to the two print heads 61 and 62 denote the pathway of the ink supply conduits 71 through 76 (see FIGS. 3 and 4). As clearly understood from the example of FIG. 6, it is not necessary that the types of inks allocated to the two print heads 61 and 62 (that is, the types of inks jetted from the respective print heads 61 and 62) coincide with the types of inks allocated to the two ink cartridges 81 and 82 (that is, the types of inks stored in the respective ink cartridges 81 and 82). Coinciding the types of inks allocated to the print heads 61 and 62 with the types of inks allocated to the ink cartridges 81 and 82, however, preferably simplifies the arrangement of the ink pathways.

The respective print heads 61 and 62 are integrally formed as sintered bodies including piezoelectric elements. It is rather difficult to form a large number of nozzles in the sintered body with a high accuracy. An increase in number of nozzles in one print head accordingly lowers the manufacturing yield. Another technique forms each array of nozzles through mechanical connection. In this structure, an increase in number of nozzles in one print head also results in the lowered manufacturing yield.

In the structure of the first embodiment, the nozzles are divided into two groups, which are formed separately in the different print heads 61 and 62. This arrangement effectively reduces the number of nozzles included in the respective print heads 61 and 62, and facilitates the manufacture of the print heads, compared with the conventional structure in which all the nozzles are formed in one print head.

The relative positions of the nozzles included in one print head can be specified with a comparatively high accuracy both in the case where the print head is integrally formed as a sintered body and in the case where the respective nozzle arrays are connected mechanically. The accuracy of the relative positions of the nozzles formed in different print heads is generally lower than the accuracy of the relative positions of the nozzles formed in one print head. This is because a positional error occurs when the two print heads 61 and 62 are fixed to each other as one assembly. Because of this reason, the relative positions of the nozzles included in the three nozzle arrays $K_D$, $C_D$, and $M_D$ formed on the first print head 61 have a comparatively high accuracy, and the relative positions of the nozzles included in the three nozzle arrays $C_L$, $M_L$, and $Y_D$ formed on the second print head 62 also have a comparatively high accuracy. The relative positions of the nozzles included in the deep cyan nozzle array $C_D$ and those included in the light cyan nozzle array $C_L$, on the other hand, have a comparatively low accuracy.

In the actual state, one print head assembly may apparently appear as an integral print head. In the present invention, even when the print head assembly seemingly appears as an integral print head, in case that plural sets of nozzle arrays respectively having the comparatively high relative positional accuracy of nozzles are present across a certain distance in the print head, the respective sets of nozzle arrays are regarded as separate print heads. This is because it is rather difficult to ascertain the comparatively high relative positional accuracy of nozzles between the respective sets of nozzle arrays, when the sets of nozzle arrays included in the apparent one nozzle head are apart from each other.

As described above, the nozzles for the six different types of inks are positioned to be aligned in one straight line extending in the main scanning direction. This arrangement effectively prevents deterioration of the picture quality due to misalignment of dots of different colors in the sub-scanning direction. In the structure of the first embodiment, however, the print head assembly 60 is divided into the two print heads 61 and 62. There is accordingly a possibility of some misalignment of the dots formed by the first print head 61 and the second print head 62 in the sub-scanning direction. This problem commonly arises when the print head assembly includes a plurality of print heads. The structure of the first embodiment relieves the trouble by specifying the types of inks allocated to each print head.

Three types of inks, that is, light cyan ink $C_L$, light magenta ink $M_L$, and yellow ink $Y_D$ (hereinafter referred to as inks of comparatively low densities), are mainly used to print some natural images, such as photographs of landscape and portrait. The other three types of inks, that is, black ink $K_D$, deep cyan ink $C_D$, and deep magenta ink $M_D$ (hereinafter referred to as inks of comparatively high densities), are, on the other hand, hardly used for these natural images. In the structure of the first embodiment shown in FIG. 6, the nozzle arrays for these three types of inks $C_L$, $M_L$, and $Y_D$, which are mainly used for the natural images, are formed in the identical print head 62. This arrangement ascertains the comparatively high positional accuracy of the dots formed by these three types of inks. The structure of the print head assembly that includes two separate print heads can keep the picture quality of such natural images reproduced by these dots substantially equivalent to the picture quality realized by the conventional structure. Among the inks of comparatively low densities $C_L$, $M_L$, and $Y_D$, the yellow ink $Y_D$ is inconspicuous compared with the other two inks, so that misalignment of yellow dots from the dots of the other inks little affects the picture quality. The nozzle array of yellow ink $Y_D$ may thus be formed in a different print head from the print head on which the nozzle arrays of light cyan ink $C_L$ and light magenta ink $M_L$ are formed. It is accordingly preferable that at least the nozzle arrays of light cyan ink $C_L$ and light magenta ink $M_L$ are formed in an identical print head.

The deep cyan ink $C_D$, the deep magenta ink $M_D$, and the black ink $K_D$ are mainly used to print images of comparatively high densities. In the structure of the first embodiment, the nozzle arrays of these three types of inks $C_D$, $M_D$, and $K_D$ are formed in the identical print head 61. This arrangement ascertains the comparatively high positional accuracy of the dots formed by these three types of inks. The structure of the print head assembly that includes two separate print heads can keep the picture quality of the images of comparatively high densities substantially equivalent to the picture quality realized by the conventional structure.

In the first embodiment, the second print head 62, which jets the inks of comparatively low densities, has the higher positional accuracy of the impact area of the ink jetted therefrom, compared with the first print head 61, which jets the inks of comparatively high densities.

Ink (more precisely, a droplet of ink) jetted from each nozzle on the print head impacts on a printing medium, such as a printing sheet. It is here desirable that the ink impacts at a reference impact position, which is determined in advance corresponding to the position of the nozzle on the print head. An actual impact position may, however, be deviated from the reference impact position. The tendency of deviation depends upon each print head. The positional accuracy of the impact area represents the tendency of deviation of the actual impact position from the reference impact position, which depends upon each print head. The positional accuracy of the impact area accordingly denotes the accuracy of the position where ink jetted from each nozzle on the print head impacts on the printing medium.

Figure 7B:
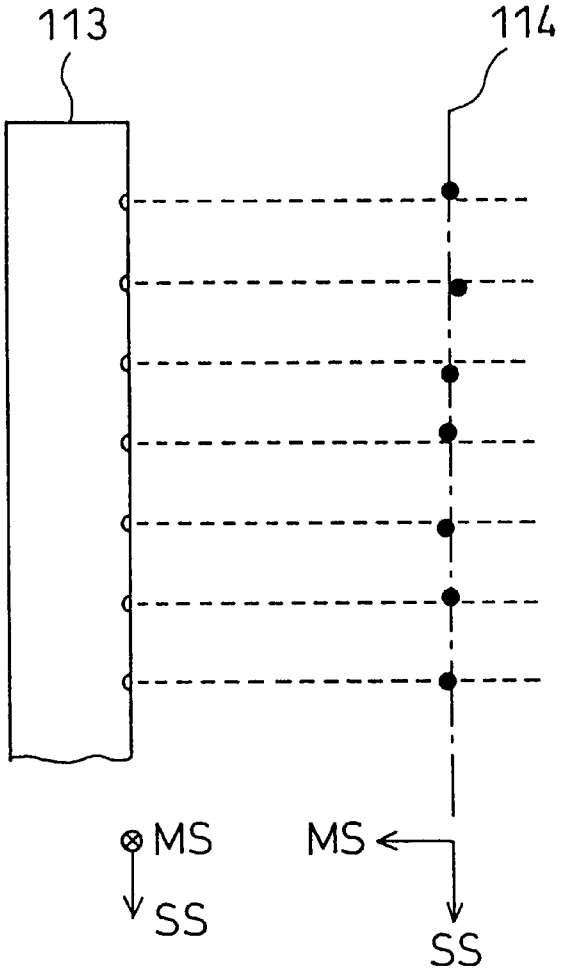
FIG. 7B shows a print head having a comparatively low positional accuracy of the impact area of the ink jetted therefrom.
Figure 7A:
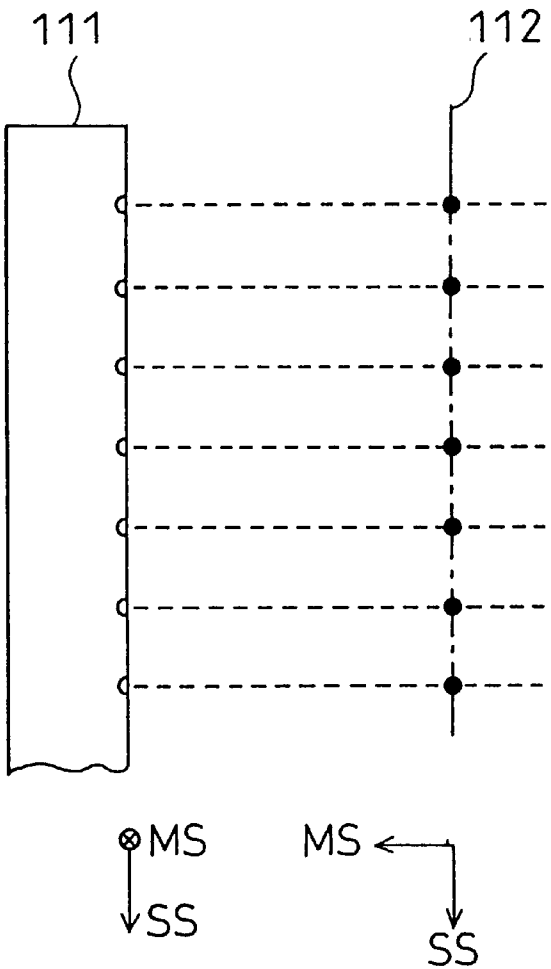
FIG. 7A shows a print head having a comparatively high positional accuracy of the impact area of the ink jetted therefrom.

FIGS. 7A and 7B respectively show a print head having a comparatively high positional accuracy of the impact area of the ink jetted therefrom and a print head having a comparatively low positional accuracy of the impact area of the ink jetted therefrom, for the purpose of comparison.

As shown in FIG. 7A, on a print head 111 having a comparatively high positional accuracy of the impact area, impact positions 112 of ink jetted from the respective nozzles substantially coincide with reference impact positions corresponding to the positions of the respective nozzles on the print head 111 (that is, intersections of the one-dot chain line and the broken line in FIG. 7). The impact positions 112 are accordingly arrayed in the main scanning direction MS and in the sub-scanning direction SS. On a print head 113 having a comparatively low positional accuracy of the impact area shown in FIG. 7B, on the other hand, impact positions 114 of ink jetted from the respective nozzles are a little deviated from the reference impact positions. The impact positions 114 are accordingly scattered in the main scanning direction MS and in the sub-scanning direction SS.

The positional accuracy of the impact area of the ink in each manufactured print head is measured by actually jetting ink from the print head. The respective print heads are then classified into grades, based on the results of the measurement. In the first embodiment, the print head classified into the grade of the high positional accuracy of the impact area is used for the second print head 62, and the print head classified into the other grade is used for the first print head 61.

The first embodiment adopts the print head having a comparatively high positional accuracy of the impact area for the second print head 62 that jets the inks of comparatively low densities. This arrangement reduces banding and harshness in a printed natural image and thereby prevents deterioration of the picture quality.

It is not necessary to adopt the print head having a comparatively high positional accuracy of the impact area for the first print head 61 that jets the inks of comparatively high densities. This arrangement does not lower the manufacturing yield of the print head.

As discussed previously, among the inks of comparatively low densities (that is, the light cyan ink $C_L$, the light magenta ink $M_L$, and the yellow ink $Y_D$), the yellow ink $Y_D$ is more inconspicuous than the other two inks and little affects the picture quality. The nozzle array of the yellow ink $Y_D$ may thus be formed in a different print head from the print head on which the nozzle arrays of the light cyan ink $C_L$ and the light magenta ink $M_L$ are formed. It is not necessary to adopt the print head having a comparatively high positional accuracy of the impact area for the print head on which the nozzle array of yellow ink $Y_D$ is formed. It is accordingly preferable that the print head having a comparatively high positional accuracy of the impact area is adopted at least for the print head that jets the light cyan ink $C_L$ and the light magenta ink $M_L$.

Figure 8:
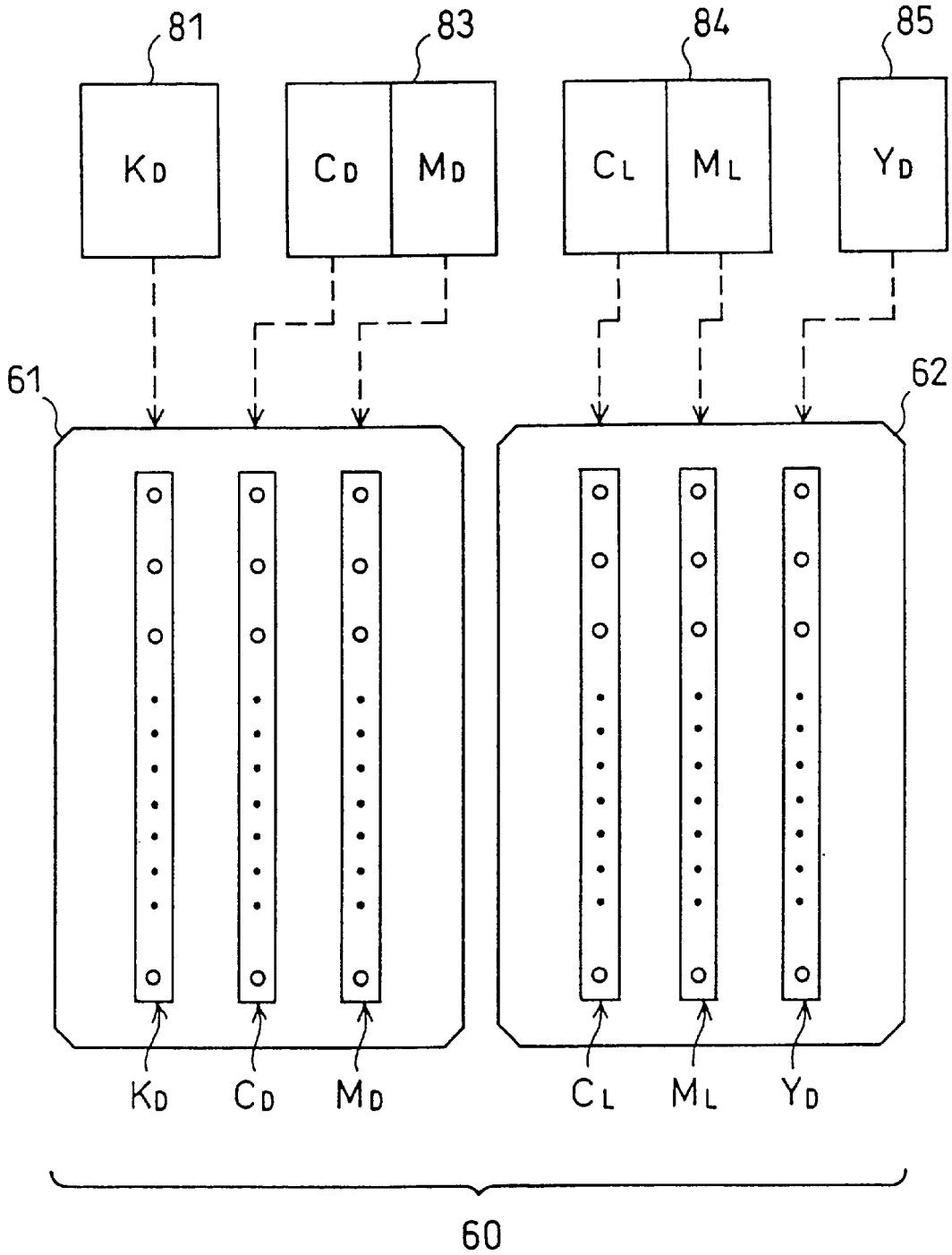
FIG. 8 illustrates another possible structure of ink cartridges applied for the print head assembly in the first embodiment.

FIG. 8 illustrates another possible structure of ink cartridges applied for the print head assembly 60 in the first embodiment. The structure of FIG. 8 includes four ink cartridges, that is, an ink cartridge 81 for exclusively storing the black ink $K_D$, an ink cartridge 83 having vessels for storing the deep cyan ink $C_D$ and the deep magenta ink $M_D$, an ink cartridge 84 having vessels for storing the light cyan ink $C_L$ and the light magenta ink $M_L$, and an ink cartridge 85 for exclusively storing the yellow ink $Y_D$. The light cyan ink $C_L$ and the light magenta ink $M_L$ are mainly used to print the natural images, and these inks may accordingly be used up earlier than the other inks. Separation of the ink cartridge 84 including the vessels of the two light inks $C_L$ and $M_L$ from the cartridges of the other inks effectively saves waste of the other inks in replacement of the ink cartridges. In a similar manner, it is preferable that the ink cartridge 83 including the vessels of the two deep inks $C_D$ and $M_D$ is separate from the cartridges of the other inks. The black ink $K_D$ and the yellow ink $Y_D$ generally have greater amounts of consumption than those of the cyan inks and the magenta inks. It is accordingly preferable that the ink cartridges of the black ink $K_D$ and the yellow ink $Y_D$ are separate from the cartridges of the other inks. The separate structure of the ink cartridges as shown in FIG. 8 significantly saves the waste of the respective inks.

Figure 9:
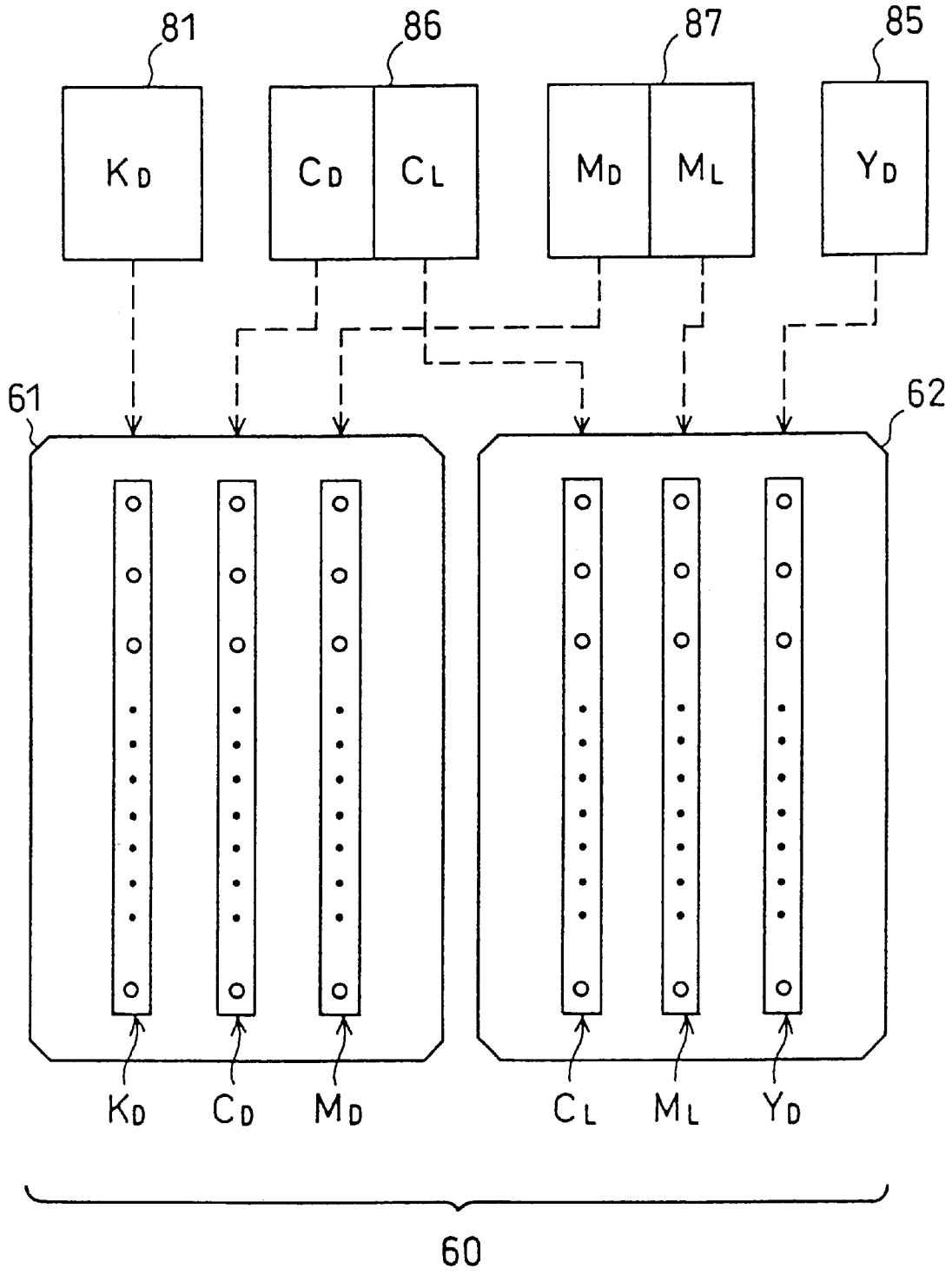
FIG. 9 illustrates still another possible structure of ink cartridges applied for the print head assembly in the first embodiment.

FIG. 9 illustrates still another possible structure of ink cartridges applied for the print head assembly 60 in the first embodiment. The difference of the structure of FIG. 9 from the structure of FIG. 8 is that vessels of the deep cyan ink $C_D$ and the light cyan ink $C_L$ are included in an identical ink cartridge 86, whereas vessels of the deep magenta ink $M_D$ and the light magenta ink $M_L$ are included in an identical ink cartridge 87. The structure of FIG. 9 is preferable when the deep cyan ink and the light cyan ink are consumed at a substantially equal rate and the deep magenta ink and the light magenta ink are consumed at a substantially equal rate.

Figure 10:
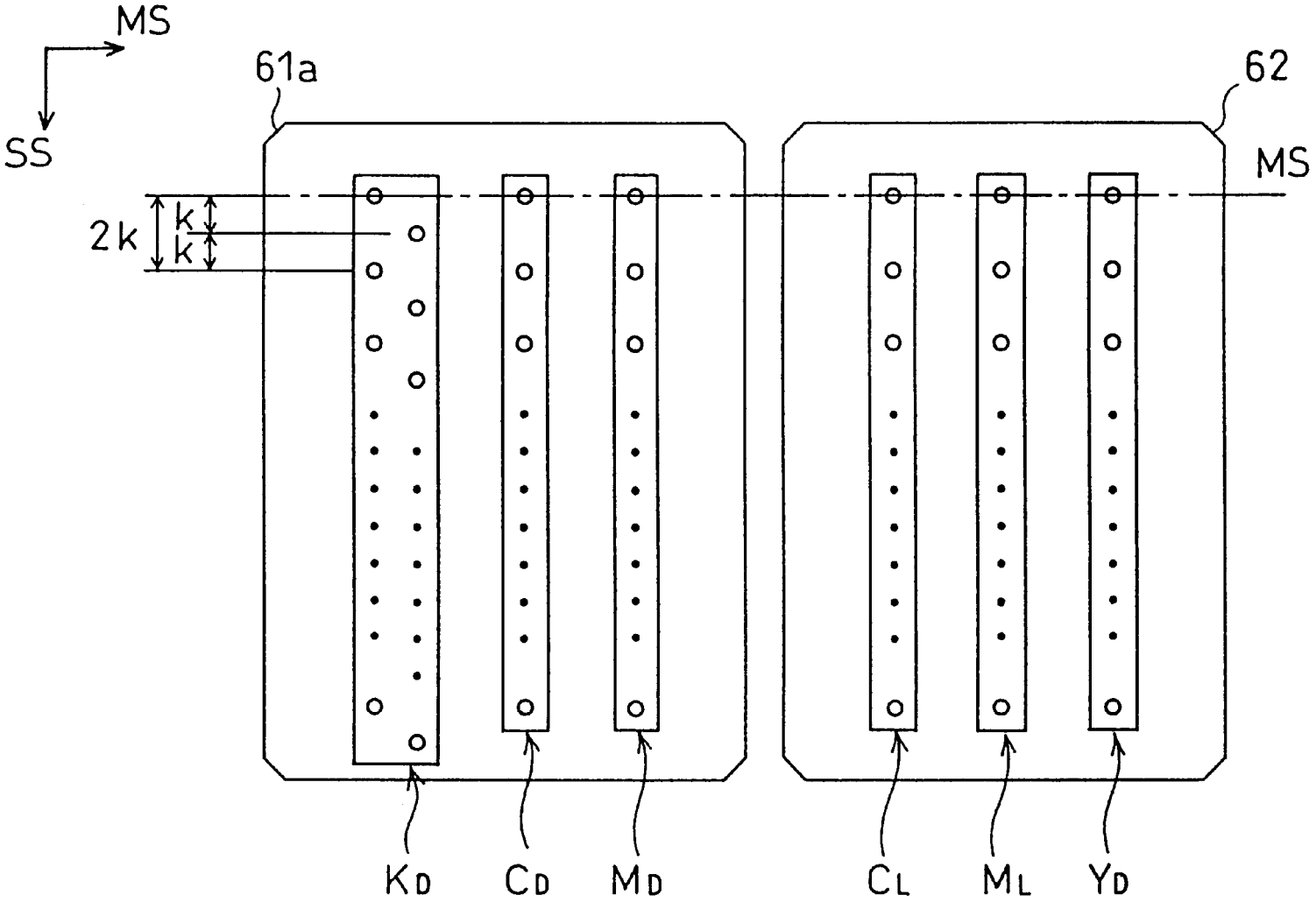
FIG. 10 illustrates the structure of a print head assembly in a second embodiment according to the present invention.

FIG. 10 illustrates the structure of a print head assembly in a second embodiment according to the present invention. The difference of the structure of the second embodiment from the structure of the first embodiment shown in FIG. 6 is the arrangement of the nozzle array $K_D$ of black ink in a first print head 61*a*. The second print head 62 of the second embodiment has the same structure as that of the first embodiment. In the first print head 61*a* of the second embodiment shown in FIG. 10, the nozzle array $K_D$ of black ink includes nozzles arranged in zigzag. The nozzles of the black ink $K_D$ are arranged at a nozzle pitch of 2k on two straight lines extending in the sub-scanning direction SS. The substantial pitch k of the nozzles of the black ink $K_D$ arranged in two columns is half the nozzle pitch 2k of the other inks. The standard nozzle pitch 2k is, for example, equal to 8 dots. The increase in number of nozzles of the black ink enables letters and characters to be printed at a higher speed.

The zigzag arrangement of the nozzles like the example of FIG. 10 also corresponds to the state in which the nozzles of an identical ink are arrayed substantially along the sub-scanning direction. It is not necessary that the nozzles of each ink are aligned in a straight line along the sub-scanning direction. The nozzles of the inks other than the black ink may also be arranged in zigzag.

Because of the reason discussed in the first embodiment, in the structure of the second embodiment, the second print head 62, which jets the inks of comparatively low densities, has the higher positional accuracy of the impact area of the ink jetted therefrom, compared with the first print head 61*a*, which jets the inks of comparatively high densities.

Figure 11:
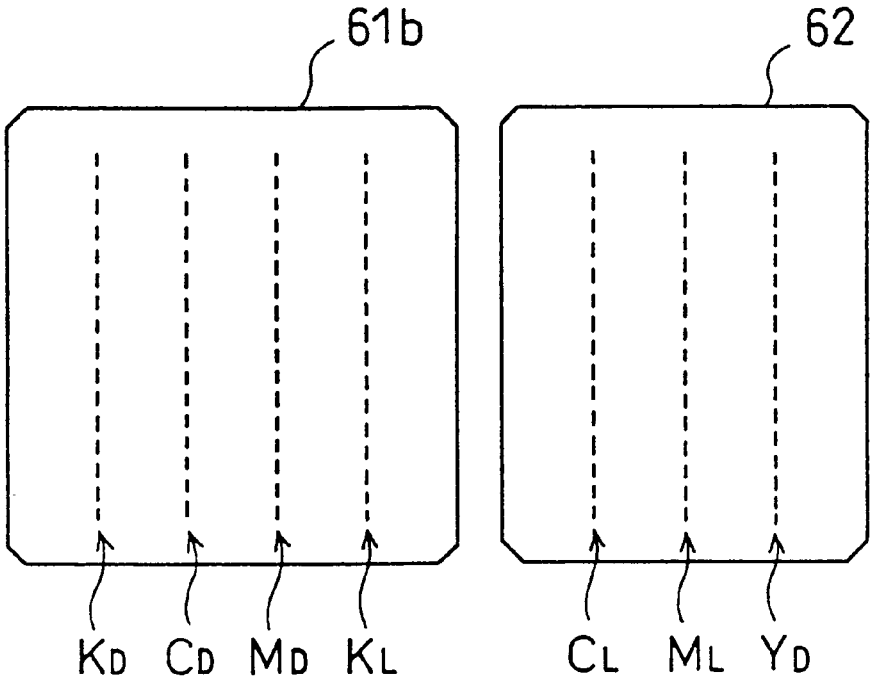
FIG. 11 illustrates the structure of a print head assembly in a third embodiment according to the present invention.

FIG. 11 illustrates the structure of a print head assembly in a third embodiment according to the present invention. The difference of the structure of the third embodiment from the structure of the first embodiment shown in FIG. 6 is addition of a nozzle array $K_L$ of light black ink to a first print head 61*b*. The second print head 62 of the third embodiment has the same structure as that of the first embodiment. For convenience of illustration, the respective nozzle arrays are shown by the broken lines in FIG. 11. Arrangement of the nozzle arrays of the deep black ink $K_D$ and the light black ink $K_L$ (that is, gray ink) in one identical print head ascertains the high positional accuracy of the black dots.

Because of the reason discussed in the first embodiment, in the structure of the third embodiment, the second print head 62, which jets the inks of comparatively low densities, has the higher positional accuracy of the impact area of the ink jetted therefrom, compared with the first print head 61*b*, which jets the inks of comparatively high densities.

Figure 12:
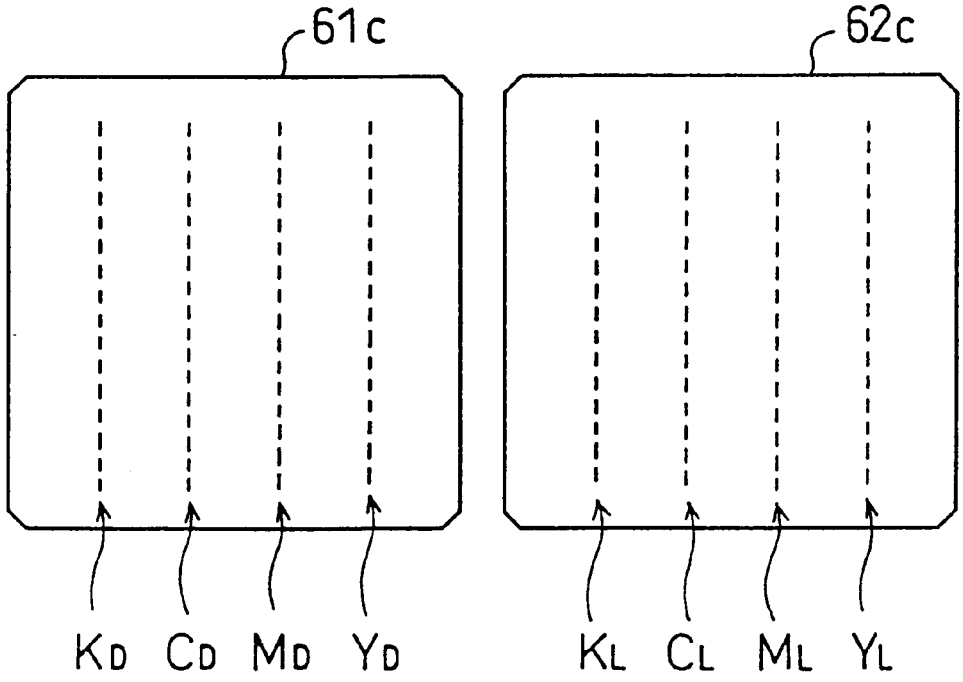
FIG. 12 illustrates the structure of a print head assembly in a fourth embodiment according to the present invention.

FIG. 12 illustrates the structure of a print head assembly in a fourth embodiment according to the present invention. In the fourth embodiment, both the deep ink and the light ink are provided for the four colors, black, cyan, magenta, and yellow. In this case, nozzle arrays of four deep inks $K_D$, $C_D$, $M_D$, and $Y_D$ are formed in one print head 61*c*, which ascertains the high positional accuracy of the dots formed by the deep inks. In a similar manner, nozzles arrays of four light inks $K_L$, $C_L$, $M_L$, and $Y_L$ are formed in one print head 62*c*, which ascertains the high positional accuracy of the dots formed by the light inks.

Because of the reason discussed in the first embodiment, in the structure of the fourth embodiment, the second print head 62*c*, which jets the inks of comparatively low densities, has the higher positional accuracy of the impact area of the ink jetted therefrom, compared with the first print head 61*c*, which jets the inks of comparatively high densities.

Figure 13:
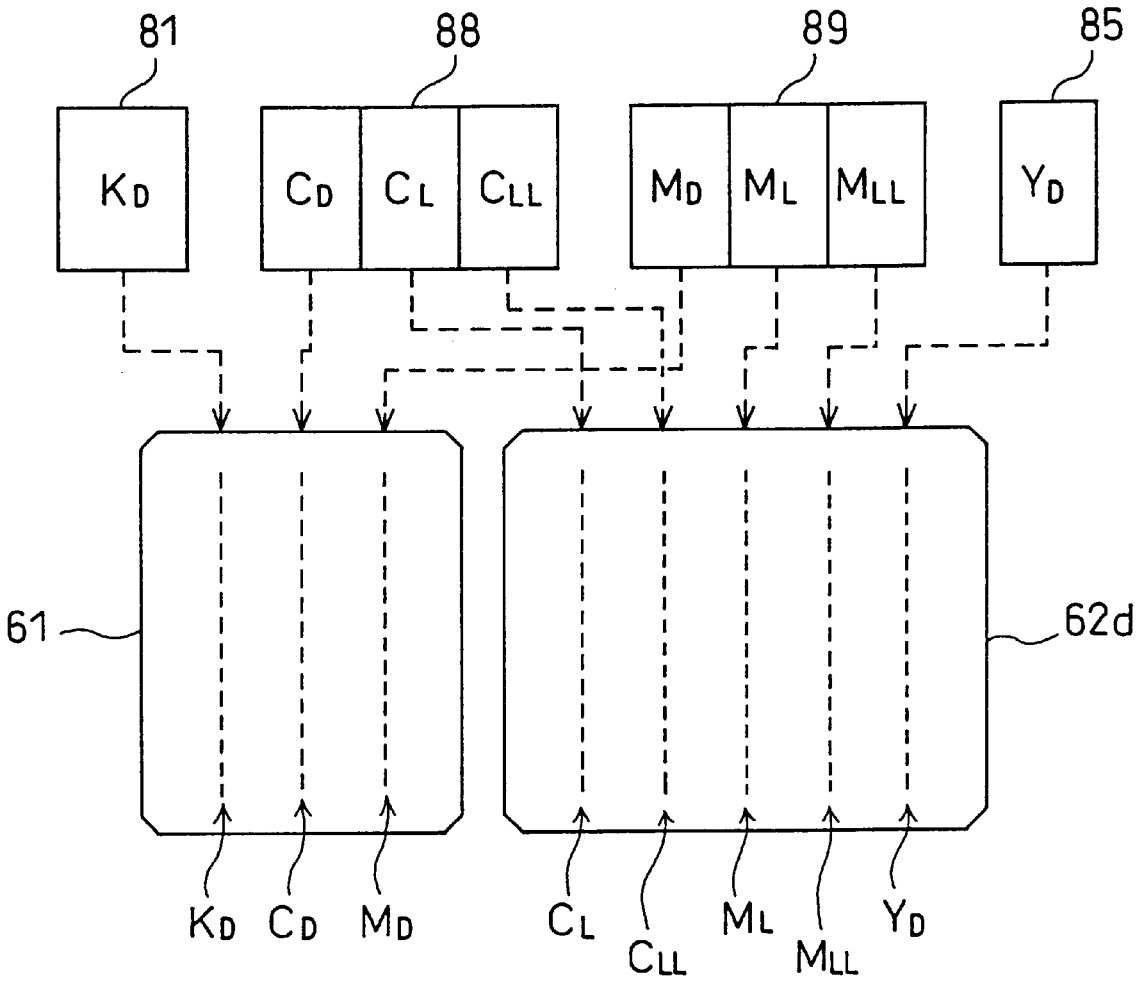
FIG. 13 illustrates the structure of a print head assembly and ink cartridges in a fifth embodiment according to the present invention.

FIG. 13 illustrates the structure of a print head assembly and ink cartridges in a fifth embodiment according to the present invention. The difference of the structure of the fifth embodiment from the structure of the first embodiment shown in FIG. 6 is addition of a nozzle array $C_{LL}$ of very light cyan ink and a nozzle array $M_{LL}$ of very light magenta ink to a second print head 62*d*. The first print head 61 of the fifth embodiment has the same structure as that of the first embodiment. The very light cyan ink $C_{LL}$ and the very light magenta ink $M_{LL}$ are inks of lower densities than those of the light inks $C_L$ and $M_L$. Vessels of the deep cyan ink $C_D$, the light cyan ink $C_L$, and the very light cyan ink $C_{LL}$ are included in one ink cartridge 88, whereas vessels of the deep magenta ink $M_D$, the light magenta ink $M_L$, and the very light magenta ink $M_{LL}$ are included in one ink cartridge 89.

Figure 14:
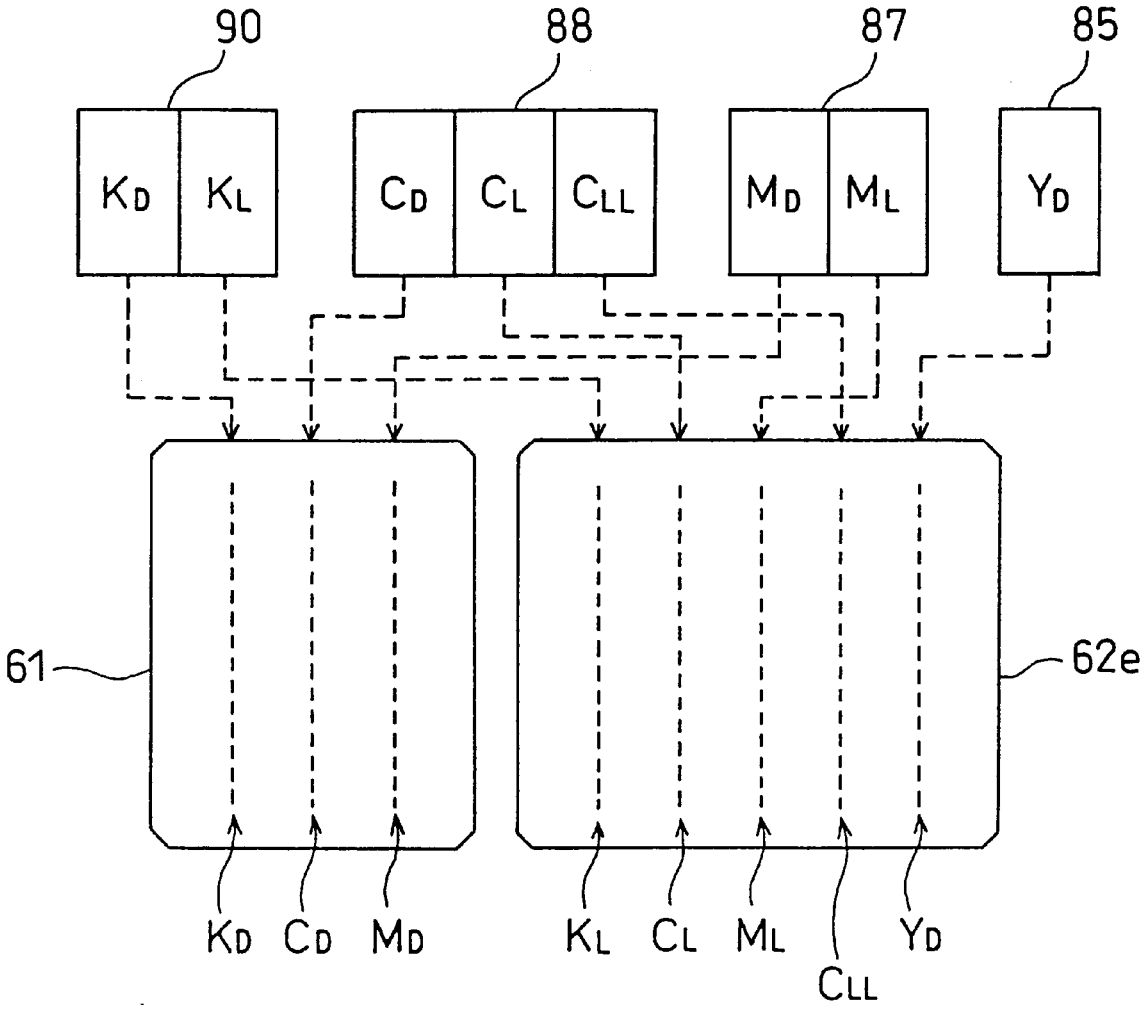
FIG. 14 illustrates the structure of a print head assembly and ink cartridges in a sixth embodiment according to the present invention.

FIG. 14 illustrates the structure of a print head assembly and ink cartridges in a sixth embodiment according to the present invention. The difference of the structure of the sixth embodiment from the structure of the first embodiment shown in FIG. 6 is addition of a nozzle array $K_L$ of light black ink and a nozzle array $C_{LL}$ of very light cyan ink to a second print head 62*e*. The first print head 61 of the sixth embodiment has the same structure as that of the first embodiment. Vessels of the deep cyan ink $C_D$, the light cyan ink $C_L$, and the very light cyan ink $C_{LL}$ are included in one ink cartridge 88, whereas vessels of the deep black ink $K_D$ and the light black ink $K_L$ are included in one ink cartridge 90.

Like the examples shown in FIGS. 13 and 14, arrangement of the nozzle arrays of various light inks and very light inks in an identical print head ascertains the high positional accuracy of the dots formed by the light inks and the very light inks. In a similar manner, arrangement of the nozzle arrays of various deep inks in an identical print head ascertains the high positional accuracy of the dots formed by the deep inks. The vessels of the deep ink, the light ink, and the very light ink of an identical color are included in one ink cartridge. This structure enables the user to purchase a desired ink cartridge without any confusion.

Because of the reason discussed in the first embodiment, in the structure of the fifth and the sixth embodiments, the second print heads 62*d* and 62*e*, which jet the inks of comparatively low densities, have the higher positional accuracy of the impact area of the ink jetted therefrom, compared with the first print head 61, which jets the inks of comparatively high densities.

Figure 15:
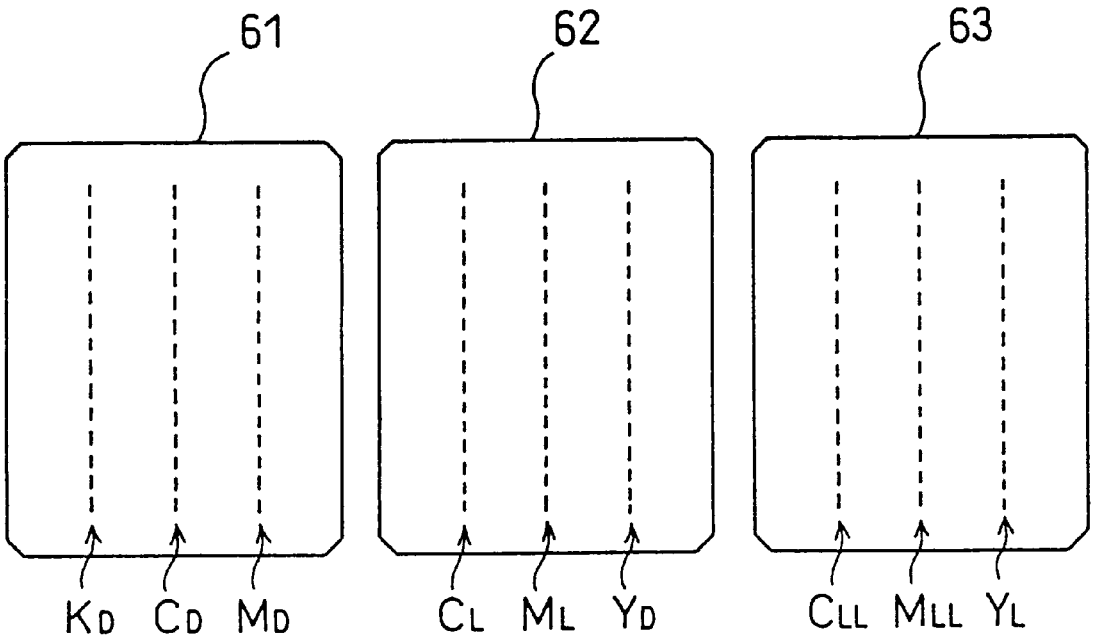
FIG. 15 illustrates the structure of a print head assembly in a seventh embodiment according to the present invention.

FIG. 15 illustrates the structure of a print head assembly in a seventh embodiment according to the present invention. The difference of the structure of the seventh embodiment from the structure of the first embodiment shown in FIG. 6 is addition of another print head 63 to the two print heads 61 and 62. The nozzle array $C_{LL}$ of very light cyan ink, the nozzle array $M_{LL}$ of very light magenta ink, and the nozzle array $Y_L$ of light yellow ink are formed in the third print head 63. The first print head 61 and the second print head 62 of the seventh embodiment have the same structure as those of the first embodiment.

In the structure of the seventh embodiment, the two nozzle arrays $C_{LL}$ and $M_{LL}$ of very light inks are formed in the identical print head 63, which ascertains the high positional accuracy of the dots formed by these very light inks. Compared with the structure of FIG. 13, this structure reduces the number of nozzles included in one print head, thereby improving the manufacturing yield of each print head. A primary disadvantage of this structure is high possibility of the positional error occurring when the three print heads 61 through 63 are fixed and assembled. From that point of view, the two divisions of the print head is preferential over the three divisions.

Because of the reason discussed in the first embodiment, in the structure of the seventh embodiment, the second print head 62 and the third print head 63, which jet the inks of comparatively low densities, have the higher positional accuracy of the impact area of the ink jetted therefrom, compared with the first print head 61, which jets the inks of comparatively high densities.

As discussed above, the print head may be formed integrally as a sintered body or may be formed by mechanically combining the respective arrays of nozzles. In the latter case, for example, two arrays of nozzles are arranged in pair to construct one actuator. A plurality of such actuators are mechanically combined to yield the print head. The actuator used herein is, for example, obtained by integrally forming piezoelectric elements and ink conduits provided for the respective nozzles as a sintered body.

Figure 16:
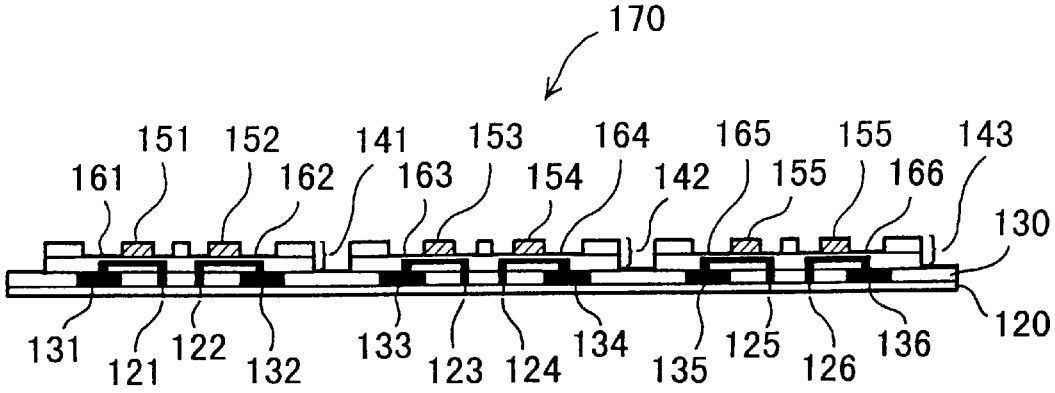
FIG. 16 is a cross sectional view illustrating a print head with a plurality of actuators.
Figure 17:
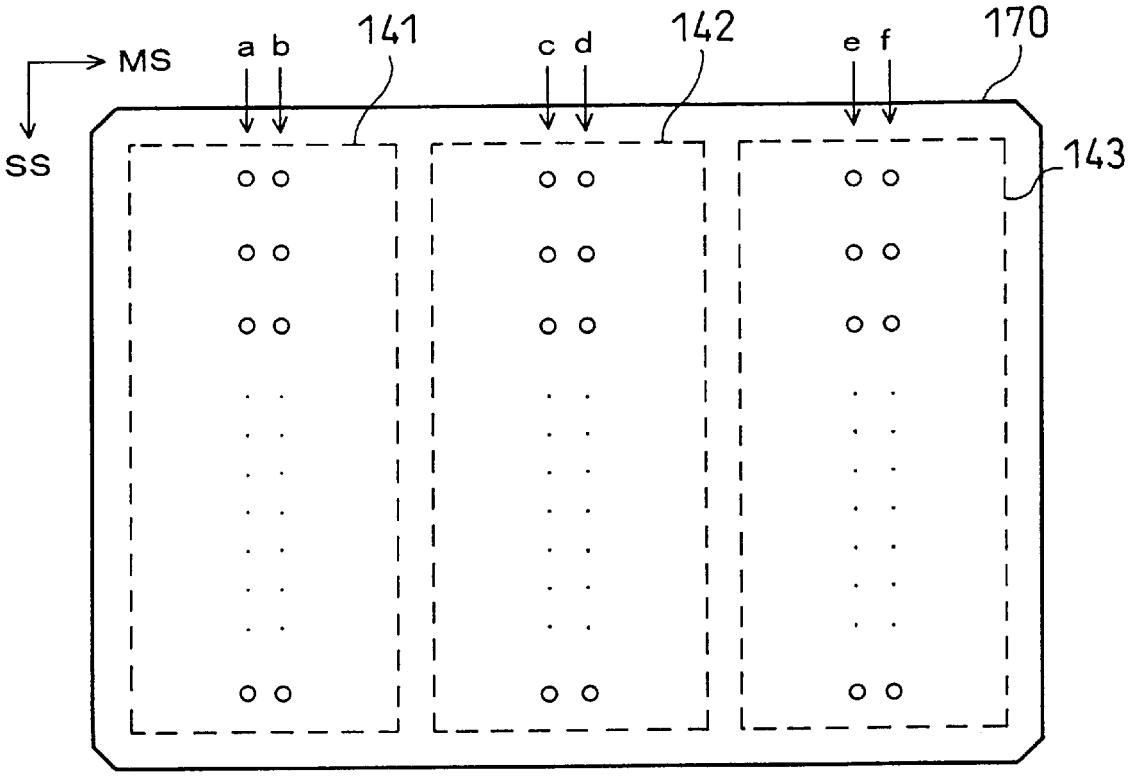
FIG. 17 shows the print head of FIG. 16 seen from the bottom.

FIG. 16 is a cross sectional view illustrating a print head with a plurality of actuators, and FIG. 17 shows the print head of FIG. 16 seen from the bottom.

A print head 170 shown in FIGS. 16 and 17 has a nozzle plate 120 arranged as a lower layer, a reservoir plate 130 laid upon the top face of the nozzle plate 120, and three actuators 141, 142, and 143 disposed on the top face of the reservoir plate 130.

The nozzle plate 120 has plural arrays of nozzles 121 through 126. Each nozzle array includes nozzles aligned in the sub-scanning direction SS, and there are six nozzle arrays 'a' through 'f' as shown in FIG. 17. The number of nozzles included in each nozzle array is, for example, 48. The six nozzle arrays are arranged, such that corresponding six nozzles from the different nozzle arrays are aligned in the main scanning direction MS.

The reservoir plate 130 has reservoirs 131 through 136 that temporarily store the inks for the respective nozzle arrays.

Each of the actuators 141 through 143 is provided for each pair of nozzle arrays. By way of example, the actuator 141 corresponding to the nozzle arrays 'a' and 'b' includes piezoelectric elements 151 and 152 and ink conduits 161 and 162 provided for the respective nozzles. In a similar manner, the actuator 142 corresponding to the nozzles arrays 'c' and 'd' includes piezoelectric elements 153 and 154 and ink conduits 163 and 164. The actuator 143 corresponding to the nozzle arrays 'e' and 'f' includes piezoelectric elements 155 and 156 and ink conduits 165 and 166. Each of the actuators 141 through 143 is formed integrally as a sintered body.

The print head 170 with the plurality of actuators 141 through 143 has the following problem. The respective actuators 141 through 143 may have some scatter of their electrostatic capacity and resonance frequency. The scatter of electrostatic capacity and resonance frequency among the actuators is ascribed to some difference in manufacturing conditions for sintered actuators.

The scatter of electrostatic capacity and resonance frequency among the actuators results in difference in weight among inks (more precisely, droplets of inks) jetted by the different actuators. This leads to different jetting rates of the respective inks and thereby varies the positional accuracy of the impact areas of the respective inks.

It is accordingly contemplated that there is a difference in positional accuracy among the impact areas of the inks jetted from the nozzles arrays 'a' and 'b' by the actuator 141, the impact areas of the inks jetted from the nozzle arrays 'c' and 'd' by the actuator 142, and the impact areas of the inks jetted from the nozzle arrays 'e' and 'f' by the actuator 143.

The jetting rates of the inks jetted by the same actuator are, on the other hand, substantially identical with each other, which results in substantially identical positional accuracy of the impact areas of these inks. Namely the impact areas of the inks jetted from the nozzle arrays 'a' and 'b' by the same actuator 141 have substantially identical positional accuracy. In a similar manner, the impact areas of the inks jetted from the nozzle arrays 'c' and 'd' by the same actuator 142 have substantially identical positional accuracy. The impact areas of the inks jetted from the nozzle arrays 'e' and 'f' by the same actuator 143 have substantially identical positional accuracy.

The difference in positional accuracy between the impact areas of the inks jetted by different actuators causes the following problem in dual-way printing.

Figure 18:
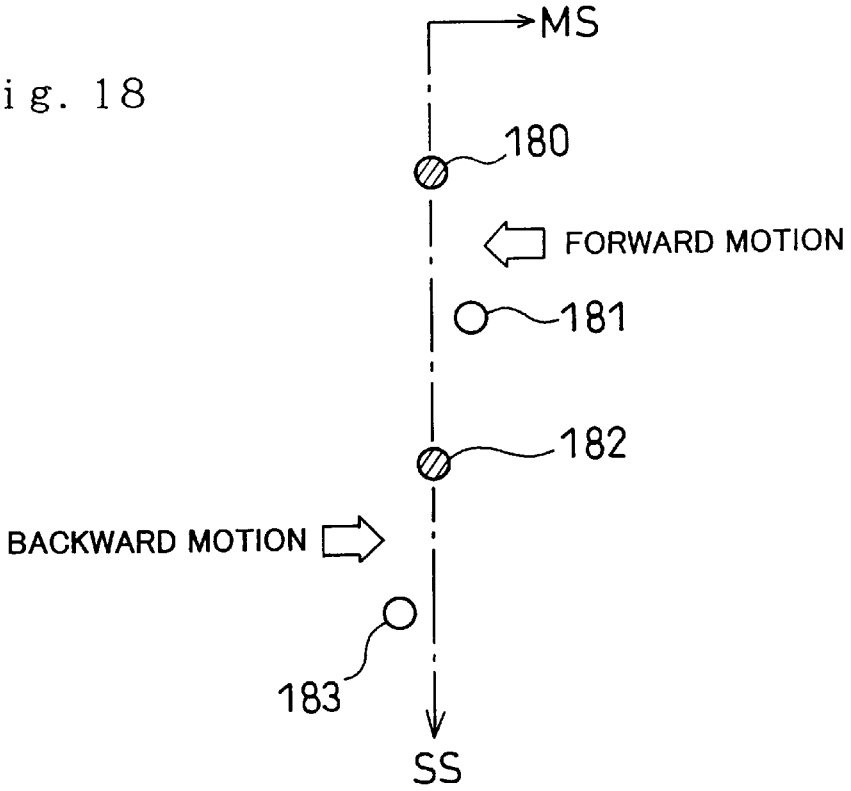
FIG. 18 shows the positions of impact areas of inks that are jetted by different actuators in dual-way printing.

FIG. 18 shows the positions of impact areas of inks that are jetted by different actuators in dual-way printing. Positions 180 and 182 represent the impact areas of the inks jetted from the nozzle arrays 'a' and 'b' by the actuator 141, whereas positions 181 and 183 represent the impact areas of the inks jetted from the nozzle arrays 'c' and 'd' by the actuator 142. The positions 180 and 181 denote the impact areas during a forward motion in the dual-way printing, and the positions 182 and 183 denote the impact areas during a backward motion. In the example of FIG. 18, the positions of the impact areas of the inks jetted from the nozzle arrays 'a' and 'b' by the actuator 141 have been adjusted in advance, such that the position in the main scanning direction MS during the backward motion is not deviated from that during the forward motion.

It is desirable that the positions of the impact areas of the inks jetted by the different actuators are not deviated from each other in the main scanning direction MS during both the forward motion and the backward motion but are aligned in the sub-scanning direction SS. While there is a difference in positional accuracy between the impact areas of the inks jetted from the different actuators, for example, if the positions of the impact areas of the inks jetted by the actuator 141 (that is, the positions of the impact areas of the inks jetted from the nozzle arrays 'a' and 'b') are adjusted to prevent a deviation of the position in the main scanning direction MS during the backward motion from that during the forward motion, the positions of the impact areas of the inks jetted by the actuator 142, which is different from the actuator 141 (that is, the positions of the impact areas of the inks jetted from the nozzle arrays 'c' and 'd'), during the forward motion and during the backward motion are significantly deviated from each other in the main scanning direction MS as illustrated in FIG. 18.

As mentioned above, the impact areas of the inks jetted by the same actuator have substantially identical positional accuracy, so that the positions of the impact areas of the inks jetted by the same actuator (for example, the positions of the impact areas of the inks jetted from the nozzle array 'a' and the nozzle array 'b') are not deviated from each other in the main scanning direction MS.

Figure 19:
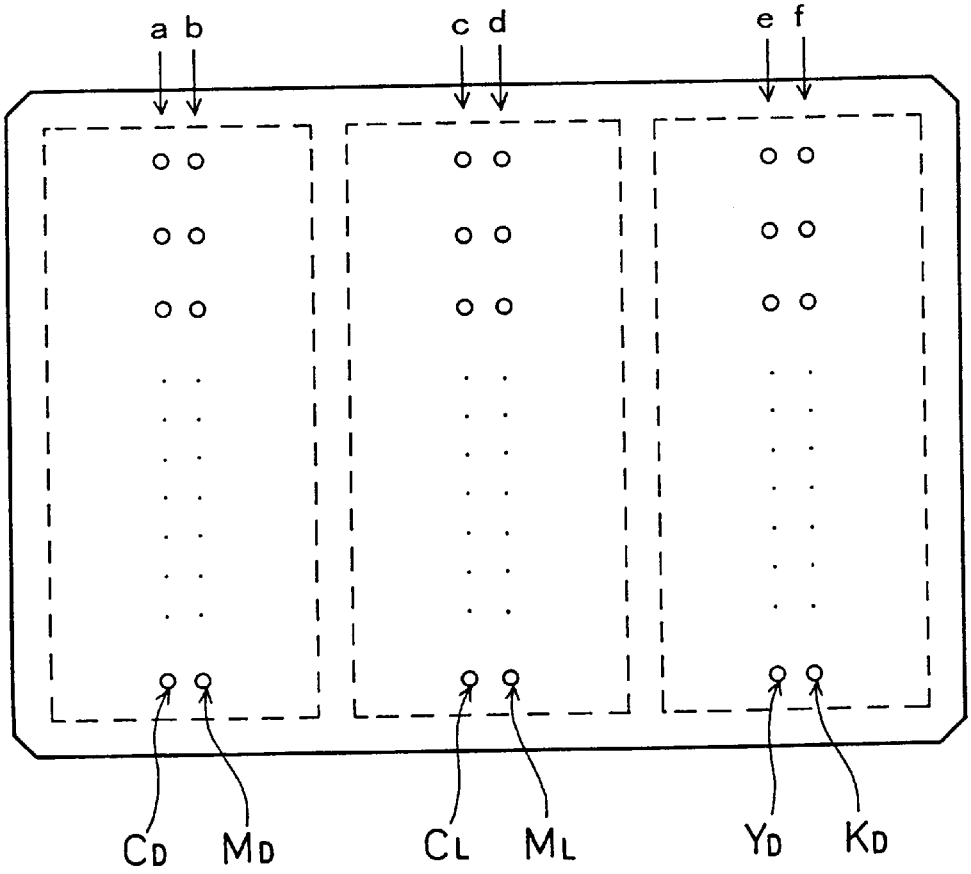
FIG. 19 illustrates the structure of a print head in an eighth embodiment according to the present invention.

FIG. 19 illustrates the structure of a print head in an eighth embodiment according to the present invention. A print head 190 shown in FIG. 19 has a similar structure to that shown in FIGS. 16 and 17. In the embodiment of FIG. 19, the nozzle array $C_D$ of deep cyan ink, the nozzle array $M_D$ of deep magenta ink, the nozzle array $C_L$ of light cyan ink, the nozzle array $M_L$ of light magenta ink, the nozzle array $Y_D$ of yellow ink, and the nozzle array $K_D$ of black ink are respectively allocated to the nozzle arrays 'a', 'b', 'c', 'd', 'e', and 'f'. Namely the deep cyan ink $C_D$ and the deep magenta ink $M_D$ are jetted by the same actuator 141. In a similar manner, the light cyan ink $C_L$ and the light magenta ink $M_L$ are jetted by the same actuator 142. The yellow ink $Y_D$ and the black ink $K_D$ are jetted by the same actuator 143.

As described previously, the light cyan ink $C_L$, the light magenta ink $M_L$, and the yellow ink $Y_D$ are mainly used for printing natural images. Since the yellow ink $Y_D$ is less conspicuous than the other two inks, a slight deviation of the dot positions by the yellow ink $Y_D$ from the dot positions by the other two inks hardly affects the picture quality. The eighth embodiment shown in FIG. 19 allows the more conspicuous light cyan ink $C_L$ and light magenta ink $M_L$ than the yellow ink $Y_D$ among the three inks $C_L$, $M_L$, and $Y_D$ primarily used for printing natural images to be jetted by the same actuator 142. This arrangement ensures the substantially identical positional accuracy of the impact areas of the two inks, thereby improving the picture quality of the natural image reproduced by these dots. Especially when the natural image is printed in dual-way printing, substantially no deviation of the positions of the impact areas of the light cyan ink $C_L$ and the light magenta ink $M_L$ in the main scanning direction MS during the backward motion from those during the forward motion effectively prevents the harshness of the resulting printed image and deterioration of the picture quality.

In the description of FIG. 18, the nozzle arrays 'a' and 'b' have been adjusted in advance to prevent the deviation of the position of the impact area of the ink in the main scanning direction MS during the backward motion from that during the forward motion. In the eighth embodiment, however, since the nozzle array $C_L$ of light cyan ink and the nozzle array $M_L$ of light magenta ink are allocated not to the nozzle arrays 'a' and 'b' but to the nozzle arrays 'c' and 'd', so that it is preferable that the adjustment is performed for the nozzle arrays 'c' and 'd'.

Figure 20:
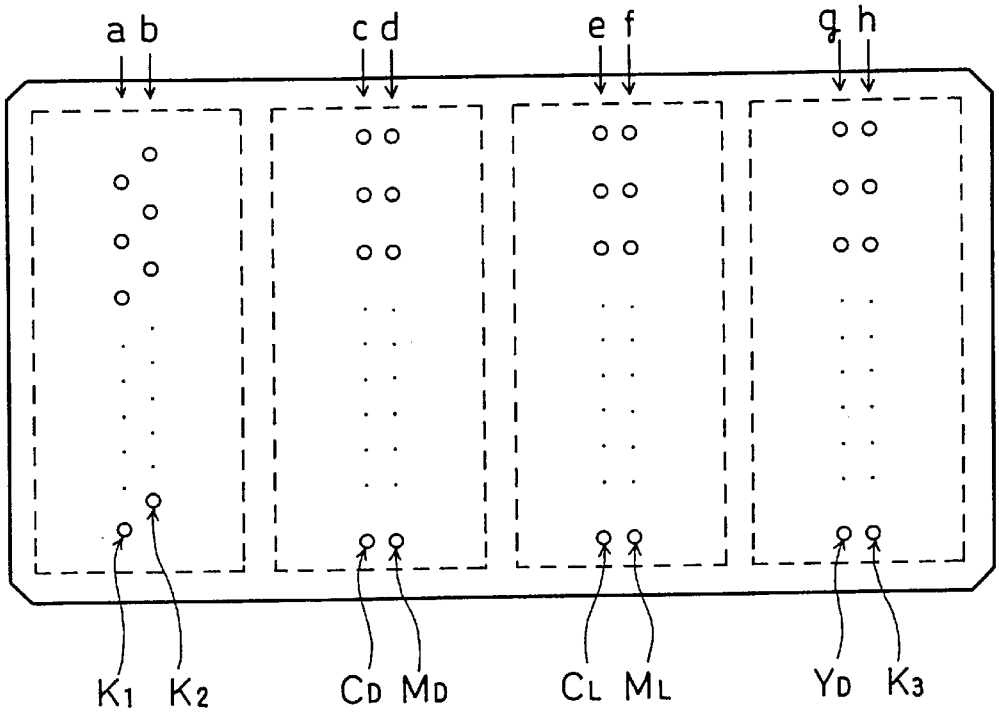
FIG. 20 illustrates the structure of a print head in a ninth embodiment according to the present invention.
Figure 21:
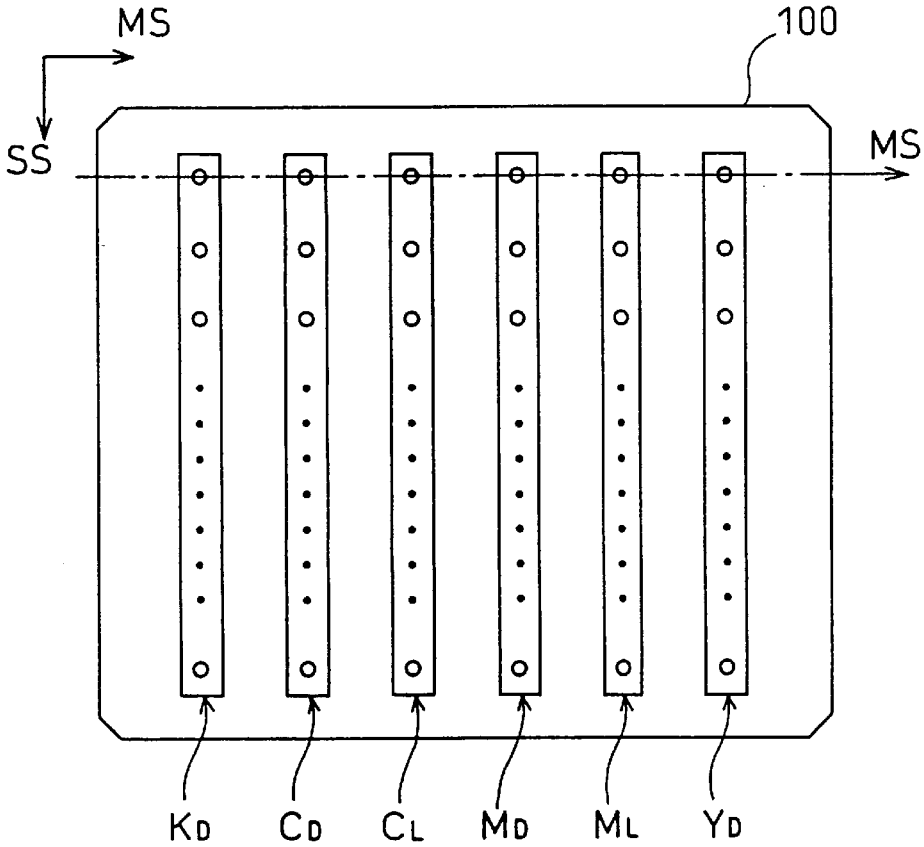
FIG. 21 shows a conventional arrangement of an ink-jet head 100 used in a printing apparatus.

FIG. 20 illustrates the structure of a print head in a ninth embodiment according to the present invention. A print head 200 shown in FIG. 20 has eight nozzle arrays 'a' through 'h', where a first nozzle array $K_1$ of black ink, a second nozzle array $K_2$ of black ink, the nozzle array $C_D$ of deep cyan ink, the nozzle array $M_D$ of deep magenta ink, the nozzle array $C_L$ of light cyan ink, the nozzle array $M_L$ of light magenta ink, the nozzle array $Y_D$ of yellow ink, and a third nozzle array $K_3$ of black ink are respectively allocated to the nozzle arrays 'a', 'b', 'c', 'd', 'e', 'f', 'g', and 'h'. The six nozzle arrays 'c' through 'h' are arranged, such that the corresponding six nozzles from the different nozzles arrays are aligned in the main scanning direction MS. Unlike these six nozzle arrays, the nozzle array 'a' to which the first nozzle array $K_1$ of black ink is allocated and the nozzle array 'b' to which the second nozzle array $K_2$ of black ink is allocated are, however, arranged, such that the respective nozzles are deviated in the sub-scanning direction SS from the straight lines along the main scanning direction MS. The increase in number of nozzles for the black ink advantageously improves the speed of printing letters and characters.

The nozzles of the color inks other than black ink may be arranged in the same manner as the black ink.

Because of the same reason as discussed in the eighth embodiment, the ninth embodiment allows the light cyan ink $C_L$ and the light magenta ink $M_L$ to be jetted by the same actuator.

The eighth embodiment and the ninth embodiment refer to the example where the present invention is applied to the single print head. Like the first through the seventh embodiments, however, the principle of the present invention may be applicable to at least one print head included in a print head assembly. It is not essential that the present invention is applied to the single print head or a print head included in the print head assembly, as long as at least the light cyan ink $C_L$ and the light magenta ink $M_L$ are jetted by the same actuator.

The present invention is not restricted to the above embodiments or their applications, but there may be many modifications, changes, and alterations without departing from the scope or spirit of the main characteristics of the present invention. Some examples of possible modification are given below.

(1) The above embodiments refer to the structure in which the ink cartridges are attached to the carriage 30. The principle of the present invention is, however, also applicable to the structure in which the ink cartridges are attached not to the carriage 30 but to a non-movable portion of the printer. The ink cartridges attached to the non-movable portion of the printer are also referred to as ink tanks. Supplies of inks from the ink tanks attached to the non-movable portion of the printer are fed to the print head through pipes. Both the ink cartridge and the ink tank correspond to the ink reservoir unit of the present invention.

(2) In the first embodiment shown in FIG. 6, the six nozzle arrays for jetting six different types of inks are arranged at the same position in the sub-scanning direction. Namely six nozzles for jetting six different inks are aligned in one straight line extending in the main scanning direction. Such arrangement is also adopted in the examples shown in FIGS. 8 and 9 and the embodiments shown in FIGS. 11 through 15. As long as the nozzle pitch is fixed, however, the plurality of nozzle arrays may be shifted from one another in the sub-scanning direction by an integral multiple of the nozzle pitch. By way of example, in the first embodiment shown in FIG. 6, the nozzle arrays $K_D$, $C_D$, $M_D$, $C_L$, $M_L$, and $Y_D$ of the respective inks may be positioned to be shifted successively by one nozzle pitch in the sub-scanning direction SS. Even in this case, at least part of the nozzles included in the respective nozzle arrays for jetting six different inks are aligned in one straight line extending in the main scanning direction. In general, arrangement of the respective nozzle arrays in the sub-scanning direction should be determined in such a manner that a plurality of nozzles for jetting plural types of inks are located on one of plural parallel lines, which respectively extend in the main scanning direction and are arranged at a fixed pitch in the sub-scanning direction.

(3) The above embodiments regard the piezoelectric-type ink-jet printers. The principle of the present invention is, however, also applicable to the bubble jet-type ink-jet printers. In other words, the principle of the present invention is applicable to any type of the ink-jet printing apparatus with a print head in which nozzles for jetting inks are formed.

It should be clearly understood that the above embodiments are only illustrative and not restrictive in any sense. The scope and spirit of the present invention are limited only by the terms of the appended claims.

What is claimed is:

1. An ink-jet printing apparatus that jets at least two types of inks having different densities with respect to at least cyan and magenta, the ink-jet printing apparatus comprising:

an ink-jet head assembly comprising a plurality of ink-jet heads mutually affixed to each other, the plurality of ink-jet heads comprising, a first ink-jet head including a plurality of deep cyan nozzles configured to jet deep cyan ink having a comparatively high density with respect to at least cyan and magenta and a plurality of deep magenta nozzles configured to jet deep magenta ink having a comparatively high density with respect to at least cyan and magenta, and a second ink-jet head including a plurality of light cyan nozzles configured to jet light cyan ink having a comparatively low density with respect to at least cyan and magenta and a plurality of light magenta nozzles configured to jet light magenta ink having a comparatively low density with respect to at least cyan and magenta;

wherein the nozzles of said second ink-jet head are configured to jet ink toward a targeted reference impact area on a printing medium with a greater accuracy than the nozzles of said first ink-jet head such that an actual point of impact of the ink jetted from the nozzles of said second ink-jet head deviate less from a targeted reference impact area than the ink jetted from the nozzles of said first ink-jet head.

2. An ink-jet printing apparatus in accordance with claim 1, wherein:

the second ink-jet head further comprises a plurality of yellow nozzles configured to jet yellow ink; and the first ink-jet head further comprises a plurality of black nozzles configured to jet black ink.

3. An ink-jet printing apparatus in accordance with claim 1 further comprising:

an ink reservoir unit configured to store a plurality of inks, and including at least two reservoir sections, said at least two reservoir sections comprising, a first reservoir section including at least a deep cyan vessel configured to store the deep cyan ink and a deep magenta vessel configured to store the deep magenta ink, the deep cyan vessel and the deep magenta vessel being connected with each other, and a second reservoir section including at least a light cyan vessel configured to store the light cyan ink and a light magenta vessel configured to store the light magenta ink, the light cyan vessel and the light magenta vessel being connected with each other.

4. An ink-jet printing apparatus in accordance with claim 1 further comprising:

an ink reservoir unit configured to store inks, and including at least two reservoir sections, said at least two reservoir sections comprising, a first reservoir section including at least a deep cyan vessel configured to store the deep cyan ink and a light cyan vessel configured to store the light cyan ink, the deep cyan vessel and the light cyan vessel being connected with each other, and a second reservoir section including at least a deep magenta vessel configured to store the deep magenta ink and a light magenta vessel configured to store the light magenta ink, the deep magenta vessel and the light magenta vessel being connected with each other.

5. An ink-jet printing apparatus that jets at least two types of inks having different densities with respect to at least one specific color, the ink-jet printing apparatus comprising:

an ink-jet head assembly comprising a plurality of ink-jet heads mutually affixed to each other, the plurality of ink-jet heads comprising, a first ink-jet head including a plurality of deep ink nozzles configured to jet deep ink having a comparatively high density with respect to said at least one specific color, and a second ink-jet head including a plurality of light ink nozzles configured to jet light ink having a comparatively low density with respect to said at least one specific color, wherein the nozzles of said second ink-jet head are configured to jet ink toward a targeted reference impact area on a printing medium with a greater accuracy than the nozzles of said first ink-jet head such that an actual point of impact of the ink jetted from the nozzles of said second ink-jet head deviate less from a targeted reference impact area than the ink jetted from the nozzles of said first ink-jet head.

6. An ink reservoir constructed to be attached to an ink-jet printing apparatus that jets at least two types of inks having different densities with respect to at least cyan and magenta, the ink-jet printing apparatus comprising an ink-jet head assembly comprising a plurality of ink-jet heads that are mutually affixed to each other, the plurality of ink-jet heads comprising, a first ink-jet head including a plurality of deep cyan nozzles configured to jet deep cyan ink having a comparatively high density with respect to at least cyan and magenta and a plurality of deep magenta nozzles configured to jet deep magenta ink having a comparatively high density with respect to at least cyan and magenta, and a second ink-jet head including a plurality of light cyan nozzles configured to jet light cyan ink having a comparatively low density with respect to at least cyan and magenta and a plurality of light magenta nozzles configured to jet light magenta ink having a comparatively low density with respect to at least cyan and magenta, wherein the nozzles of said second ink-jet head jet ink toward a targeted reference impact area on a printing medium with a greater accuracy than the nozzles of said first ink-jet head so that an actual point of impact of the ink jetted from the nozzles of said second ink-jet head deviate less from the targeted reference impact area than the ink jetted from the nozzles of said first ink-jet head, the ink reservoir comprising:

at least two reservoir sections, comprising, a first reservoir section including at least a deep cyan vessel configured to store the deep cyan ink and a deep magenta vessel configured to store the deep magenta ink wherein the deep cyan vessel and the deep magenta vessel are connected to each other, and a second reservoir section including at least a light cyan vessel configured to store the light cyan ink and a light magenta vessel configured to store the light magenta ink wherein the light cyan vessel and the light magenta vessel are connected to each other.

7. An ink reservoir constructed to be attached to an ink-jet printing apparatus that jets at least two types of inks having different densities with respect to at least cyan and magenta, the ink-jet printing apparatus comprising an ink-jet head assembly comprising a plurality of ink-jet heads that are mutually affixed to each other, the plurality of ink-jet heads comprising, a first ink-jet head including a plurality of deep cyan nozzles configured to jet deep cyan ink having a comparatively high density with respect to at least cyan and magenta and a plurality of deep magenta nozzles configured to jet deep magenta ink having a comparatively high density with respect to at least cyan and magenta, and a second ink-jet head including a plurality of light cyan nozzles configured to jet light cyan ink having a comparatively low density with respect to at least cyan and magenta and a plurality of light magenta nozzles configured to jet light magenta ink having a comparatively low density with respect to at least cyan and magenta, wherein the nozzles of said second ink-jet head jet ink toward a targeted reference impact area on a printing medium with a greater accuracy than the nozzles of said first ink-jet head so that an actual point of impact of the ink jetted from the nozzles of said second ink-jet head deviate less from the targeted reference impact area than the ink jetted from the nozzles of said first ink-jet head, the ink reservoir comprising:

at least two reservoir sections, comprising, a first reservoir section including at least a deep cyan vessel configured to store the deep cyan ink and a light cyan vessel configured to store the light cyan ink wherein the deep cyan vessel and the light cyan vessel are connected to each other, and a second reservoir section including at least a deep magenta vessel configured to store the deep magenta ink and a light magenta vessel configured to store the light magenta ink wherein the deep magenta vessel and the light magenta vessel are connected to each other.

* * * * *